US006868621B1

(12) United States Patent
Grimm et al.

(10) Patent No.: US 6,868,621 B1
(45) Date of Patent: Mar. 22, 2005

(54) CLOTHES DRYING APPARATUS AND METHOD OF DRYING CLOTHES

(75) Inventors: Curt L. Grimm, Wapello, IA (US); Kent L. Grimm, Wapello, IA (US)

(73) Assignee: Grimm Brothers Plastics Corp., Wapello, IA (US)

( * ) Notice: Subject to any disclaimer, the term of this patent is extended or adjusted under 35 U.S.C. 154(b) by 293 days.

(21) Appl. No.: 10/637,133

(22) Filed: Aug. 8, 2003

(51) Int. Cl.[7] ..... F26B 13/30

(52) U.S. Cl. ..... 34/92; 34/104; 34/202; 34/232; 34/437; 34/511

(58) Field of Search ..... 34/92, 104, 202, 34/227, 232, 233, 437, 511

(56) References Cited

U.S. PATENT DOCUMENTS

| | | | | |
|---|---|---|---|---|
| 4,180,919 A | | 1/1980 | Baltes | |
| 4,682,424 A | | 7/1987 | Irving | |
| 5,212,969 A | * | 5/1993 | Tsubaki et al. | 68/19.2 |
| 5,359,786 A | * | 11/1994 | Vierling | 34/92 |
| 5,369,892 A | | 12/1994 | Dhaemers | |
| 5,546,678 A | | 8/1996 | Dhaemers | |
| 5,815,944 A | | 10/1998 | Palmer | |
| 5,815,961 A | | 10/1998 | Estes et al. | |

OTHER PUBLICATIONS

Whirlpool Corp., DryAire Drying Cabinet, Marketing & Informational Materials 2003, www.family–studio.com/dryair.asp.

Whirlpool Corp., Personal Valet Clothes Vitalizing System, Marketing & Information Materials 2002, www.personal-valet.com.

* cited by examiner

*Primary Examiner*—Jiping Lu
(74) *Attorney, Agent, or Firm*—Brian J. Laurenzo; Jason M. Hunt; Michael C. Gilchrist

(57) ABSTRACT

A clothes drying apparatus is provided. This clothes drying apparatus comprises a cabinet with an interior region to receive clothes. At least one door is operably connected to the cabinet to allow access to the interior region thereof. Attached to the cabinet is a first intake passage for accessing and receiving air from the exterior environment of a building. A vacuum unit is also attached to the cabinet. This vacuum unit draws air from the exterior of the building, through the passage, and into the interior region of the cabinet. A second passage linked to the interior environment and a switching mechanism may also be provided to permit selective operation of the clothes drying apparatus to draw air from outdoors or indoors based on environmental conditions. Also provided is a method of drying clothes with the clothes drying apparatus.

18 Claims, 15 Drawing Sheets

CLOTHES DRYING APPARATUS AND METHOD OF DRYING CLOTHES

FIELD OF THE INVENTION

The present invention relates to the field of clothes dryers. In particular, the present invention provides a novel apparatus and method for drying clothes.

BACKGROUND OF THE INVENTION

Conventional tumble dryers are commonly used to dry wet clothing. It is also known to provide a clothes drying cabinet for those clothes that are not suitable for conventional dryers. Tumble dryers provide a constant rotation and often heat to dry clothes. This rotation and heat is known to cause damage and shrinkage to clothing dried within the conventional dryer. In particular, a risk of over-drying exists in current dryers, and particularly in those dryers that do not have sensors or other means of detecting dry clothing. Over-drying is caused by excessive or prolonged heat that is applied to clothing and, as a result, over-heats, stresses, damages, and shrinks the clothing fabrics.

Regardless of the form of dryer or method of drying, the basic principles of current drying methods and apparatuses are the same. Current dryers, in theory, attempt to simulate the effects of the sun (i.e., heat), and the wind (i.e., the movement of air and the movement of clothing) for maximum drying efficiency. Typical dryer loads can contain up to a gallon or more of water when the clothes are wet. As a result, a method for removing this water efficiently, safely, and effectively is needed. Therefore, the common conditions used for drying in current conventional dryers and clothes drying cabinets are the addition of heat, the movement of air, and the movement of clothing.

Conventional tumble dryers typically dry clothing at approximately 3.1 lbs. per kilowatt hour. Therefore, the efficiency of such dryers is relatively low, often taking an hour or more to dry a load of laundry even with the addition of heat, expending a significant amount of energy. Moreover, the efficiency of comparable models of conventional tumble clothes dryers is generally the same, with the exception that natural gas dryers are often less expensive than electric dryers to operate, primarily due to the cost of natural gas versus electricity. However, as both gas and electricity are used for heating a dryer, both expel more energy than would otherwise be required by a device that operates simply a fan or blower to circulate ambient air.

Heated air is generally believed to have a greater capacity to absorb moisture than unheated air. Therefore, current methods of drying clothes and dryers are typically directed to the incorporation of heat into the drying cycle to shorten drying times. As a result, conventional methods and devices use termination controls to provide dryer efficiency and energy savings. Termination controls shut the dryer off sooner than it otherwise would have stopped without these controls. Termination controls include simple timers, more advanced temperature sensors, and sophisticated moisture sensors. However, these controls are still prone to problems. Devices with timers and temperature sensors are likely to over-dry clothes because they cannot detect remaining moisture in the clothing. Moisture sensors are less likely to over-dry clothing, but conventional tumble dryers using such sensors do not avoid tumbling action which repeatedly jars and stretches clothing fabrics, and therefore still causes damage to fabrics.

Conventional dryers typically consist of a drum, an idler pulley assembly that assists in rotating the drum, a blower/fan assembly, air seals, a belt, a drive motor, and drum support rollers or bearings. The drive system of each dryer consists of a motor, a pulley and a belt. The drive belt transfers energy from the motor to turn the drum. While not avoiding the problems associated with over-drying and tumble drying, current conventional dryers are also available with a range of temperature and cycle options that allow customization of laundry loads for different types of fabrics and garments. For example, conventional dryers use low heat for delicate fabrics and other fabrics at risk for shrinking. Some conventional dryers include an "air fluff" cycle in which no heat is added to the drying cycle. Other features, such as a cool-down period, or a premature stop, are also used. Unfortunately, as described hereinabove, tumble drying still damages clothing fabrics. Furthermore, most of these methods use heat, which could result in over-drying clothes.

Air movement in a conventional or tumble dryer is created by the motor-driven blower/fan assembly. Room air is drawn into the dryer and over the heater or heating element. The heated air is then circulated in the drum and around the clothing and subsequently exhausted outside. Specifically, air is pulled through the dryer by the motor driven blower assembly. This room air is drawn in over the heating element and heated. Heated air is then introduced to the tumbling clothes in the drum, picking up moisture from the clothes and carrying that moisture out of the drum, often traveling through the lint screen and blower wheel, where it is exhausted to the outside. The tumbling action causes movement of clothing within the drum which is known to expose more surface area of the clothing to the moving, heated air. Therefore, the combination of heat and movement of clothes in conventional methods is believed to shorten drying times. However, aside from the problems of adding heated air which damages fabrics and overall low efficiency of such systems, tumble drying flexes cloth fibers, resulting in damage to the fabric.

Accordingly, as discussed herein, various problems exist for conventional dryers, such as over-drying clothes. Furthermore, drying partial loads of laundry wastes energy because the dryer is not being used in its full capacity. Likewise, filters used to remove lint particles are often filled with lint and must be constantly emptied to keep the dryer operating efficiently. The tumbling of clothes constantly flexes and stretches clothing fabrics, damaging the fabrics. Moreover, often items such as keys, rocks, coins, nails, metal buckles, zippers and buttons or rivets are connected to clothing, or fall out of the pockets of clothing within the dryer. When such items are introduced into a drying cycle of a conventional dryer they damage the drum, scratching and denting the inner surface of the drum as they are tumbled through a drying cycle. Eventually, enough damage is caused to the drum from dents and scratches that the drum, in turn, damages clothing placed in the dryer, such as by snagging or tearing fabric threads.

In an attempt to avoid the problems associated with conventional tumble dryers, clothes drying cabinets have been used. Clothes drying cabinets are typically used to dry clothing that is not suitable for a conventional tumble dryer, such as more delicate items. These clothes drying cabinets often require that the clothes be hung within the cabinet, or laid flat on a surface inside the cabinet. Therefore, they avoid the damage caused by tumbling in conventional dryers.

Current clothes drying cabinets typically include apertures in the cabinet that allow air to permeate into the cabinet, which air causes the evaporation of water from the clothing placed inside the cabinet. To completely dry clothes by evaporation takes a significant amount of time. Therefore, as an alternative, some clothes drying cabinets force air into the cabinet in order to accelerate the drying time of clothes inside the cabinet. However, like conventional tumble dryers, a common feature of many of these forced air clothes drying cabinets is that they add heat to the air to dry the clothes inside. Many of these clothes drying cabinets are, therefore, equally susceptible to over-drying and damaging clothes inside the cabinet. Likewise, these cabinets do not improve upon the efficiency of conventional dryers.

A clothes drying cabinet that uses heated forced air operates similar to a conventional tumble dryer. The primary difference between the two devices is the placement of clothing within the device. While clothes are "tumbled" in a conventional dryer, clothes are typically hung or laid flat within a clothes drying cabinet. Air is drawn into the clothes drying cabinet from the room in which the device is located by a blower/fan assembly, heated, and circulated within the cabinet. Current clothes drying cabinets also provide, similar to a conventional dryer, a duct system or exhaust system to vent air from the interior of the dryer to the exterior environment of a building ("outdoors" or "outside"). Typically, after the heated air is circulated through the cabinet, it is exhausted out of the cabinet, usually through a conventional dryer exhaust duct that is vented outside. Alternatively, it may be possible to recycle air, in which case, air is exhausted from the drying chamber, but is cycled into a condenser, and subsequently cooled. This cooled air may then be either exhausted or reused by reheating and reintroducing the air into the drying chamber. By using heated, and even recycled air, the air is often stale and does not "freshen" the clothes dried within the cabinet.

Some current clothes drying cabinets provide an enclosure for drying and storing clothing that has closeable doors, to provide an aesthetically pleasing appearance to the cabinet, and to conceal the clothing hung inside. These cabinets typically include a rod from which to hang clothes in the interior of the cabinet, as well as a piece of absorptive material, such as a large sponge or a piece of fabric, placed below the clothing. Clothes drying cabinets have also been provided in which the rod is mounted above a drip pan. The drip pan collects excess water that drips from clothing hung on the rod. For those cabinets that use closeable doors, apertures are in some cases provided in the doors to ventilate the cabinet with air.

As discussed previously, cabinets with apertures may avoid the use of heat, and instead allow the circulation of room air into the cabinet to cause the evaporation of water from the clothing placed within the cabinet. As a result, the cabinet avoids over-drying clothing. Additionally, because clothes are hung or rested within the cabinet, the cabinet does not cause the damage tumbling otherwise would cause to clothing in a conventional dryer. However, a cabinet that depends on the natural evaporation of water requires lengthy drying times, particularly when cabinet doors are closed. Closing the cabinet doors restricts the free flow of air into and out of the cabinet. As a result, less air will be available to dry clothes.

Furthermore, the temperature and humidity on a given day will significantly affect the drying time of clothing dried within the cabinet. For example, on a day in which the relative outdoor humidity is high, the air is typically saturated with moisture. As a result, air seeping into the cabinet will be less likely to pick-up and carry away excess moisture from the damp clothing. This leads to a significant increase in the amount of time necessary to dry clothing on a humid day because the air passing over the clothing is picking up less water. Thus, current clothes drying cabinets that depend upon the free flow of air are extremely inefficient.

As an alternative, air could be forced into the cabinet to accelerate the drying time. In some cabinets, gusts of hot dry air are forced into the cabinet from fans or blowers to dry the clothing inside. Like conventional tumble dryers, cool ambient air is drawn from the room in which the device is located into the cabinet, the air is then heated and introduced into the cabinet to dry the clothing hung in the interior of the cabinet. Specifically, ambient air is drawn into the device, heated by a gas or electric heater, and subsequently blown into the cabinet, forcing the hot air across the surface of the wet clothing to cause evaporation. The introduction of heated air, however, risks over-drying and damaging the clothes within the cabinet, and expends a significant amount of energy to heat the clothes.

Clothes drying cabinets typically draw air for use in drying from the room in which the dryer is located, or alternatively recycle air through the device. Further, while current tumble dryers provide an "air fluff" cycle, these tumble dryers do not draw air from the exterior of the building. As a result, the air often used to dry clothes is stale, and may lead to unpleasant odors in the clothes. The use of heat and humidity to de-wrinkle and refreshen clothing hung within the cabinet, likewise, does not provide clothesline freshness to the clothing, as the heat and humidity traps these stale odors within the clothing. Therefore, it would be advantageous to provide a clothes drying cabinet that draws air from the outdoors in order to create the appearance, feel, and smell of clothes that were hung from a clothesline outdoors.

Clothes drying and clothes treating cabinets are also currently available that de-wrinkle clothing by applying heated forced air, moisture, pressure, and tension to the clothing hung within the cabinet. The introduction of steam into the cabinet humidifies the clothing, while a heater and a fan are used to draw air into the cabinet from the exterior of the cabinet, and force the heated air into the cabinet. In addition to the danger of over-drying clothing, a cabinet that additionally applies moisture increases drying times. The addition of pressure and tension stretches, potentially tears, and certainly damages the fabric of clothes placed within the cabinet.

As with conventional dryers, it is also possible, in some clothes drying cabinets to adjust the heat of the air introduced into the cabinet based on the clothing type, such as permanent press, or delicate cycles, as well as adjust the velocity of the blown air, and the drying cycle time to avoid some of the problems of conventional dryers. However, as is the case with conventional dryers, these controls are still likely to damage clothing through over-drying and other problems, and are also inefficient.

In view of the foregoing, therefore, a need exists for a clothes drying cabinet that avoids the damage to clothing caused by over-drying, stretching, and flexing clothing fabrics. A need also exists for a clothes drying cabinet that efficiently dries clothes, while at the same time provides a clothesline fresh appearance, feel, and smell to the dried clothes. A need also exists for a method of drying clothes that draws air from the exterior environment of a building to provide clothesline freshness to clothes hung within a clothes drying cabinet.

The difficulties encountered in the prior art are substantially eliminated by the present invention.

BRIEF SUMMARY OF THE INVENTION

By the present invention, it is proposed to overcome the difficulties encountered heretofore. To this end, a clothes drying apparatus is provided. This clothes drying apparatus comprises a cabinet with an interior region in which to receive clothes. Attached to this cabinet is at least one door in operable connection with the cabinet to allow access to the interior region of the cabinet. Additionally, means for holding clothes is provided within the interior region of the cabinet to hold clothes that are received within the cabinet. Attached to the cabinet is a first intake passage for accessing air from the exterior environment of a building. A vacuum unit is also attached to the cabinet. This vacuum unit draws air from the outdoors, through the passage, and into the interior region of the cabinet. Also provided is a method of drying clothes with the clothes drying apparatus of the present invention.

The primary objective of the clothes drying apparatus and method of drying clothes of the present invention is to provide an efficient system for drying clothes that does not damage the clothes and provides a clothesline fresh appearance, feel, and smell to clothes dried within the apparatus.

These and other objects will become apparent upon reference to the following specification, drawings, and claims.

DETAILED DESCRIPTION OF PREFERRED EMBODIMENTS

Figure 1:
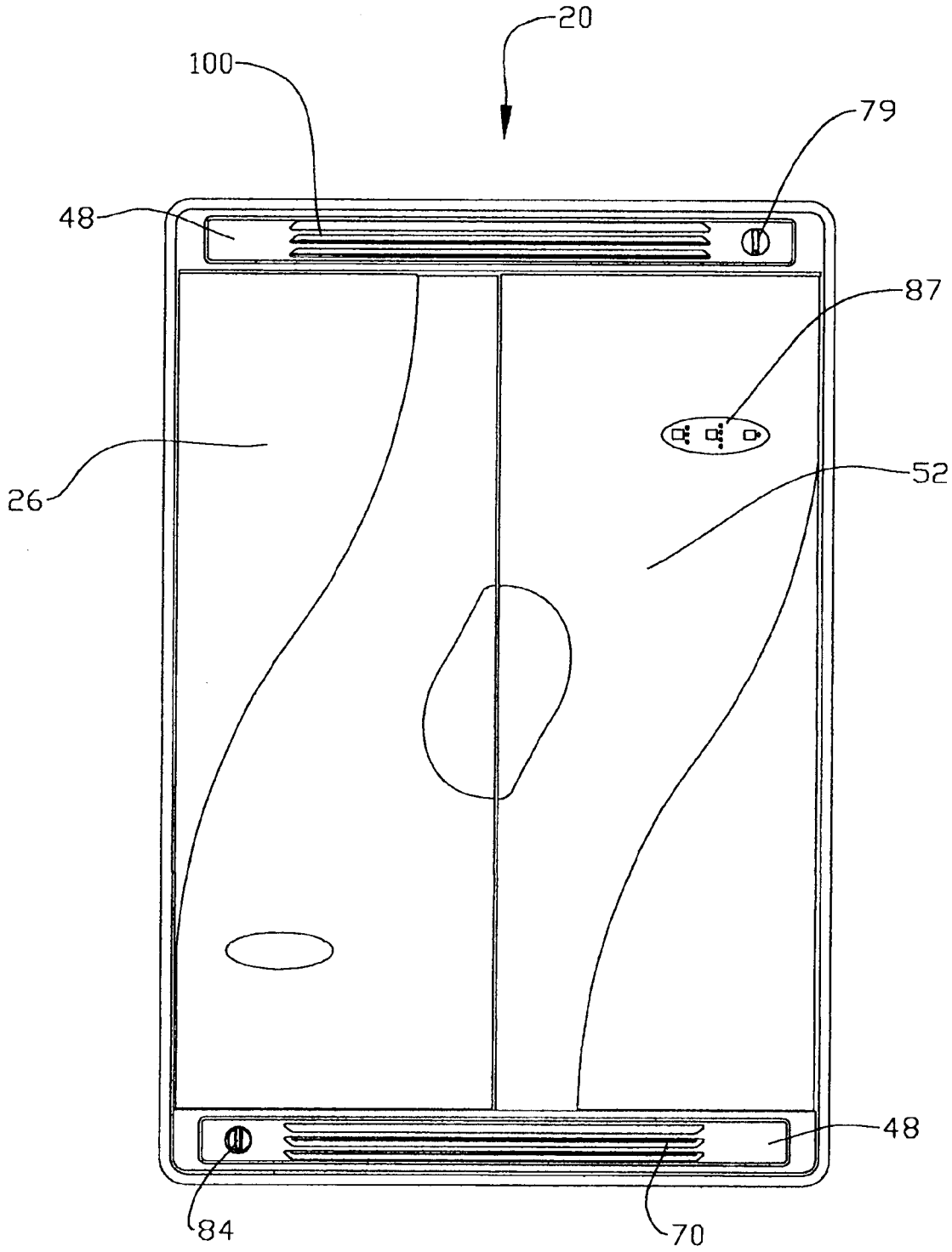
FIG. 1 shows a front view of the clothes drying apparatus of the present invention comprising an embodiment having two doors.

The Figures show a clothes drying apparatus 20 and a method of drying clothes. As discussed in further detail herein, the clothes drying apparatus 20 of the present invention comprises a cabinet 22 with an interior region 24 in which to receive clothes. This interior region 24 is defined by the walls of the cabinet 22. Additionally, attached in operable connection to the cabinet 22 is at least one door 26 that allows access to the interior region 24 of the cabinet 22. A means for holding clothes 54 that are received within the cabinet 22 is also provided within the interior region 24 of the cabinet 22. Attached to the cabinet 22 is a first intake passage 30 for accessing air from the exterior environment of a building 34, and a vacuum unit 36 for drawing air from the exterior of the building 34, or outdoors, through the first intake passage 30, and into the interior region 24 of the cabinet 22.

Figure 5:
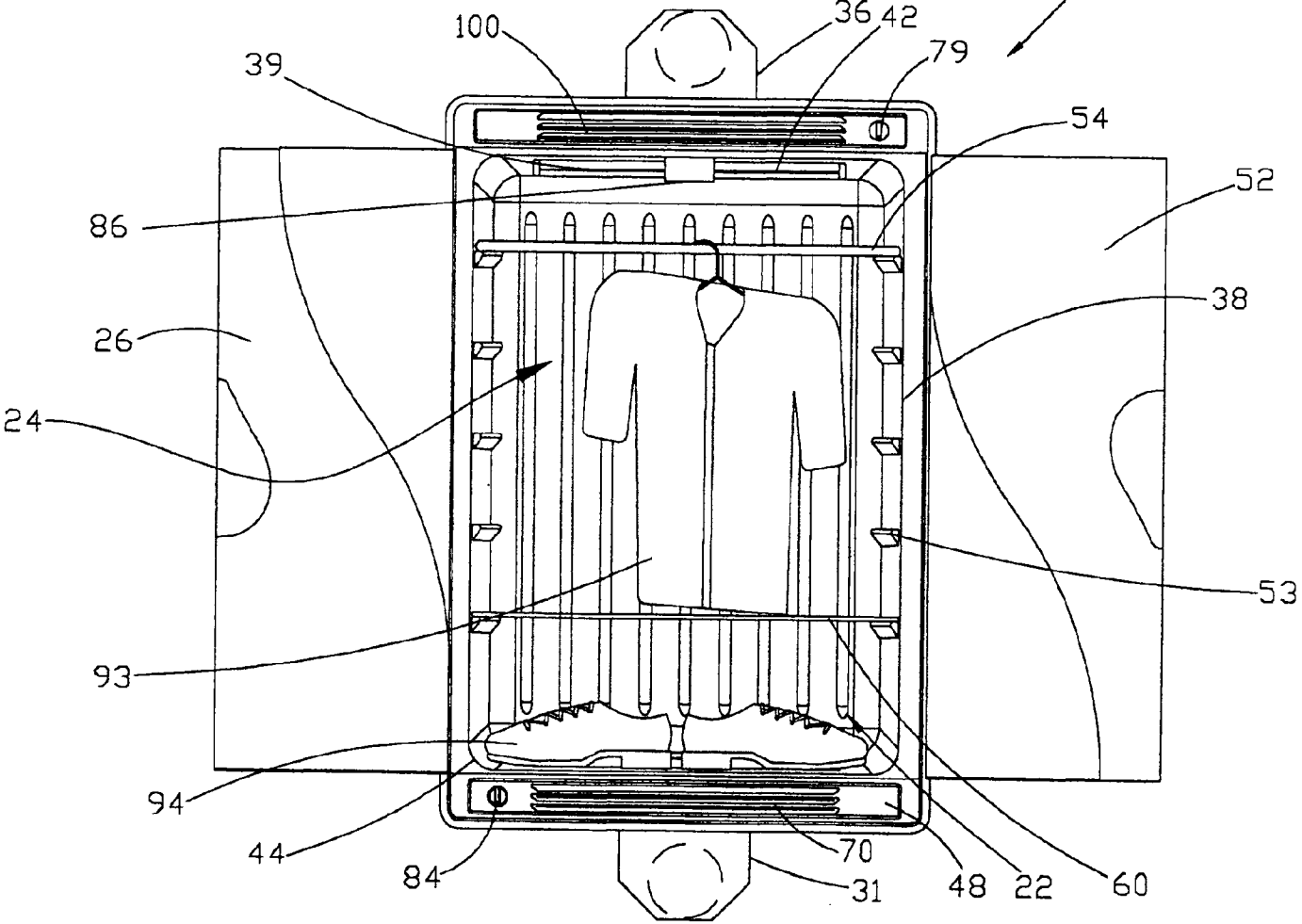
FIG. 5 shows a front view of the clothes drying apparatus of the present invention comprising a two (2) door embodiment having open doors revealing an interior region containing means for holding clothes and footwear.
Figure 6:
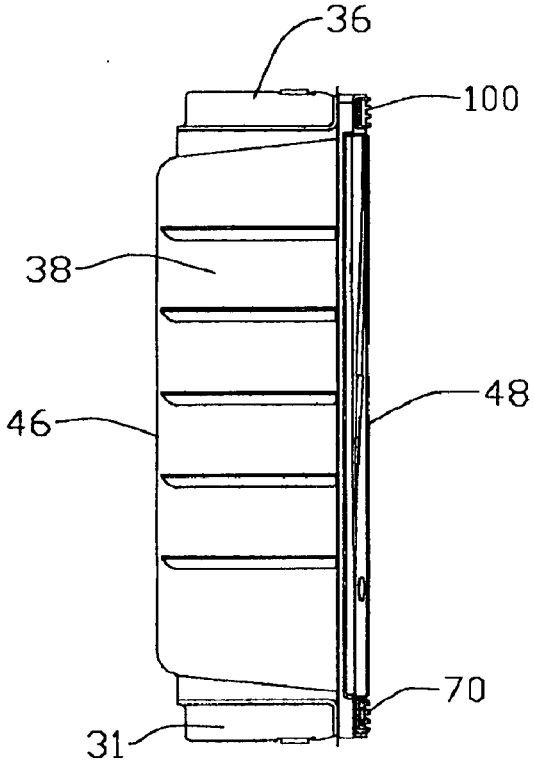
FIG. 6 shows a side view of the clothes drying apparatus of the present invention.
Figure 7:
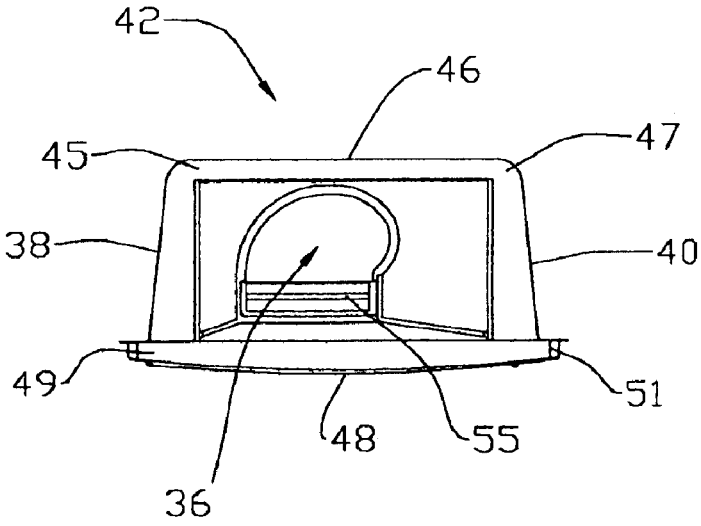
FIG. 7 shows a top view of the clothes drying apparatus of the present invention having a vacuum unit attached thereto.
Figure 8:
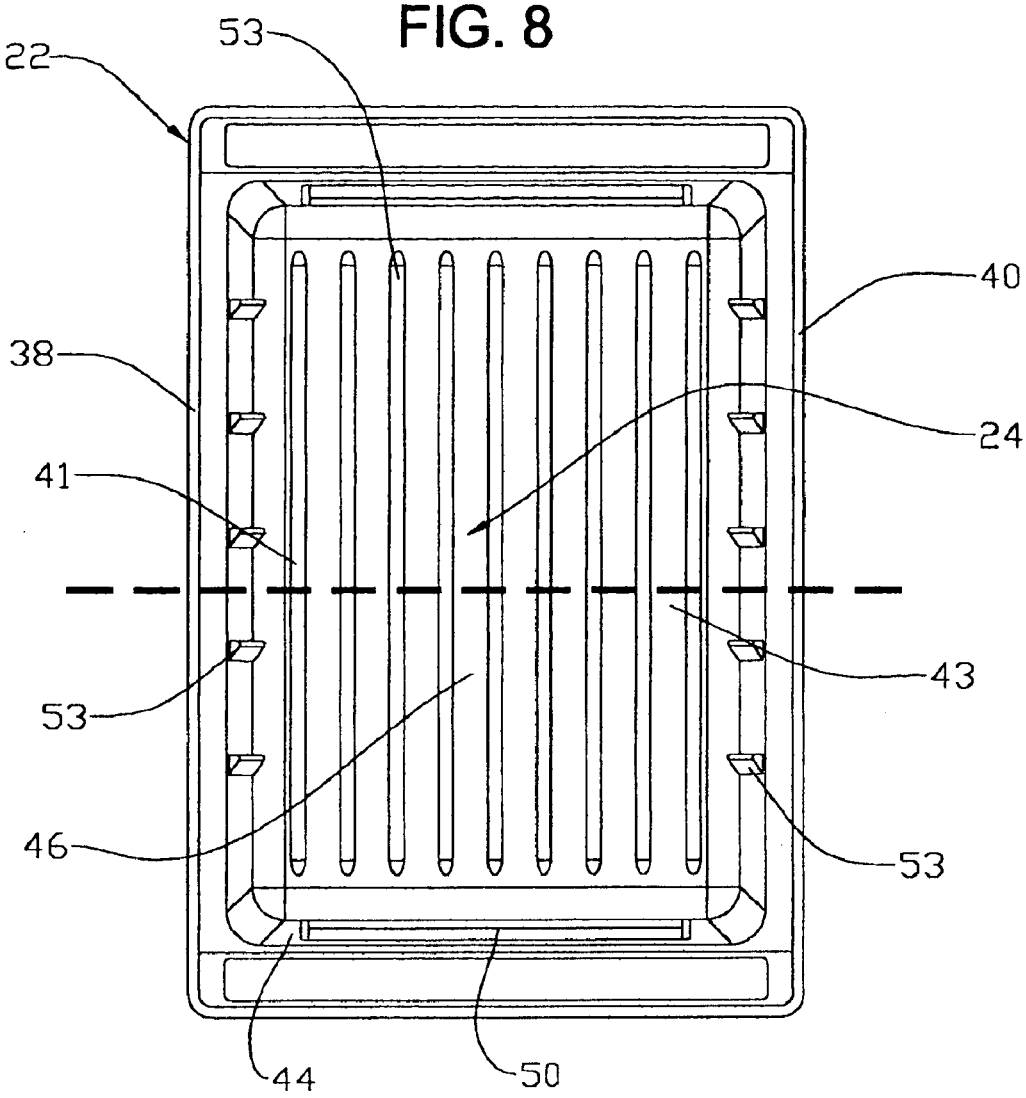
FIG. 8 shows a front view of the clothes drying cabinet of the present invention and the interior region thereof.
Figure 9:
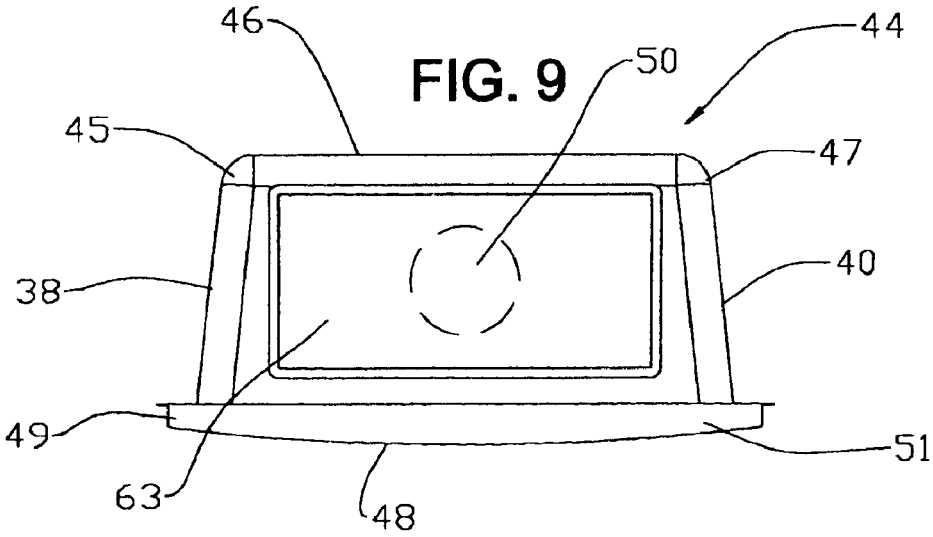
FIG. 9 shows a bottom view of the clothes drying apparatus of the present invention having a drain attached thereto.
Figure 10:
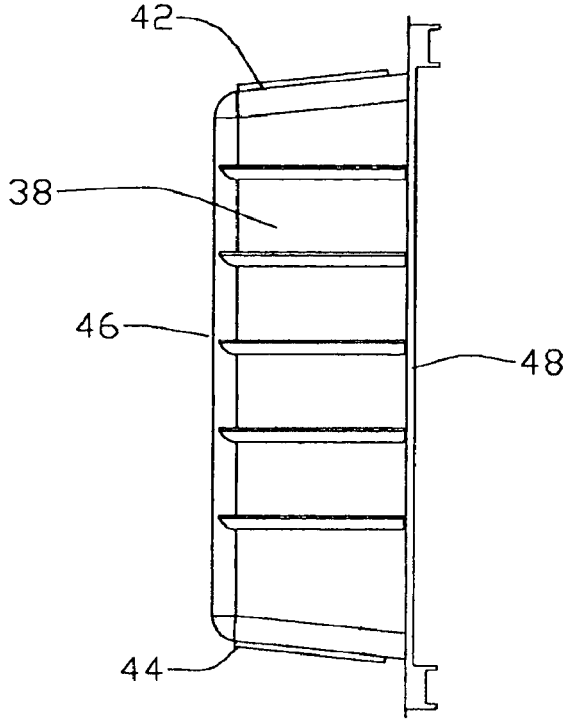
FIG. 10 shows a side view of the clothes drying cabinet of the present invention.

A preferred embodiment of the clothes drying apparatus 20 is a clothes drying cabinet 22 (FIGS. 5, 8). This clothes drying cabinet 22 is for use in drying clothing that is not suitable for a conventional dryer. While not limiting the foregoing, clothes not suitable for a conventional dryer often include delicate fabrics, and fabrics that will shrink when exposed to heat. The clothes drying cabinet 22 has an interior region 24. This interior region 24 is defined by the structure of the cabinet 22 which has a floor 44 horizontally positioned at a lower region 43 of the cabinet 22. Extending vertically from the floor 44 are a first wall 38, and a second wall 40 opposite the first wall 38. The first wall 38 and the second wall 40 are in contact with a ceiling 42 horizontally positioned in an upper region 41 of the cabinet 22. A rear wall 46 also extends vertically from the floor 44 and is in contact with the ceiling 42. The rear wall 46 is also in contact with a rear edge 45, 47 of each of the first 38 and second 40 walls. Accordingly, the combination of the first wall 38, second wall 40, ceiling 42, floor 44, and rear wall 46 preferably form a box shaped container or cabinet with an opening at one side (See FIGS. 6–12).

Figure 2:
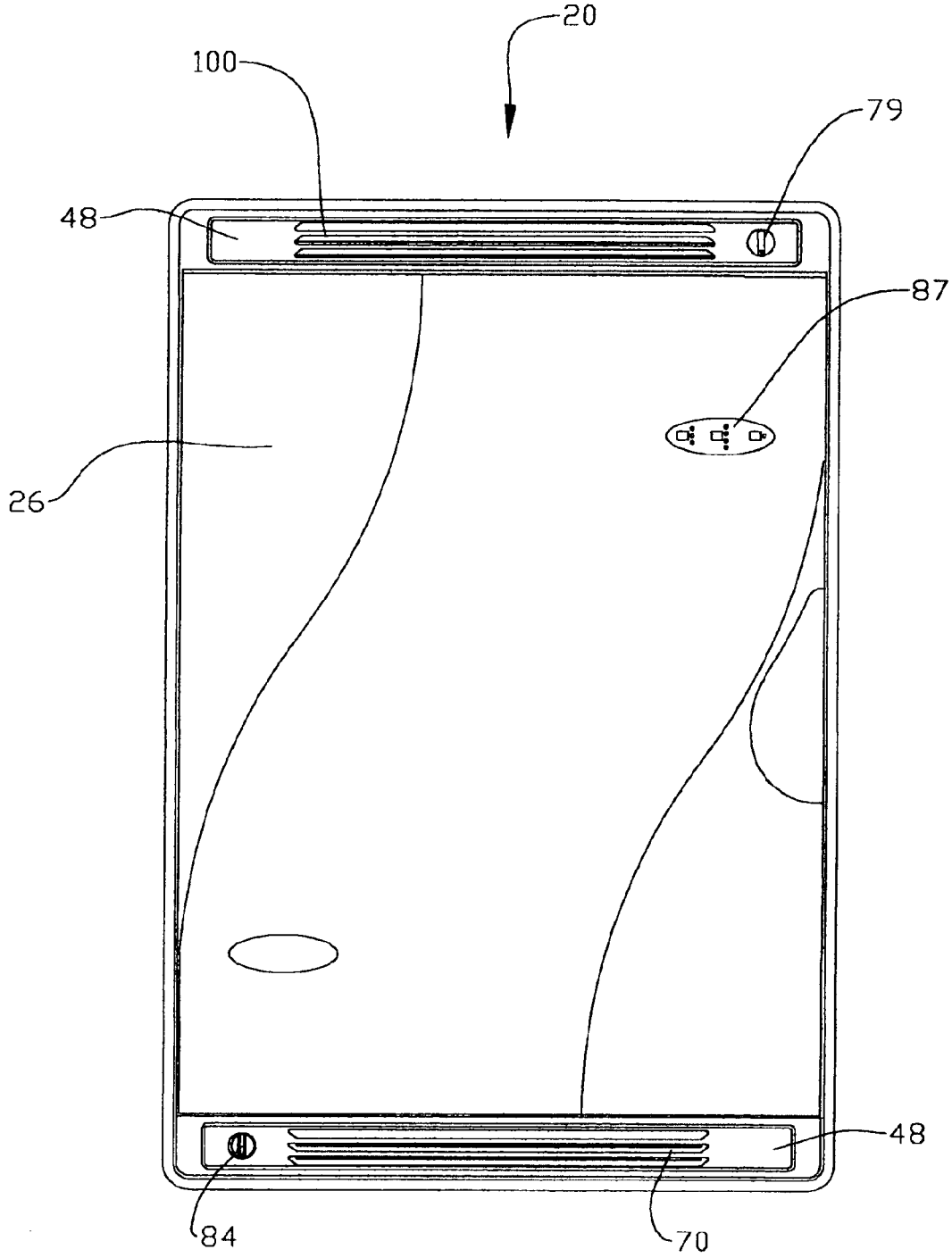
FIG. 2 shows a front view of the clothes drying apparatus of the present invention comprising an embodiment having one door.
Figure 3:
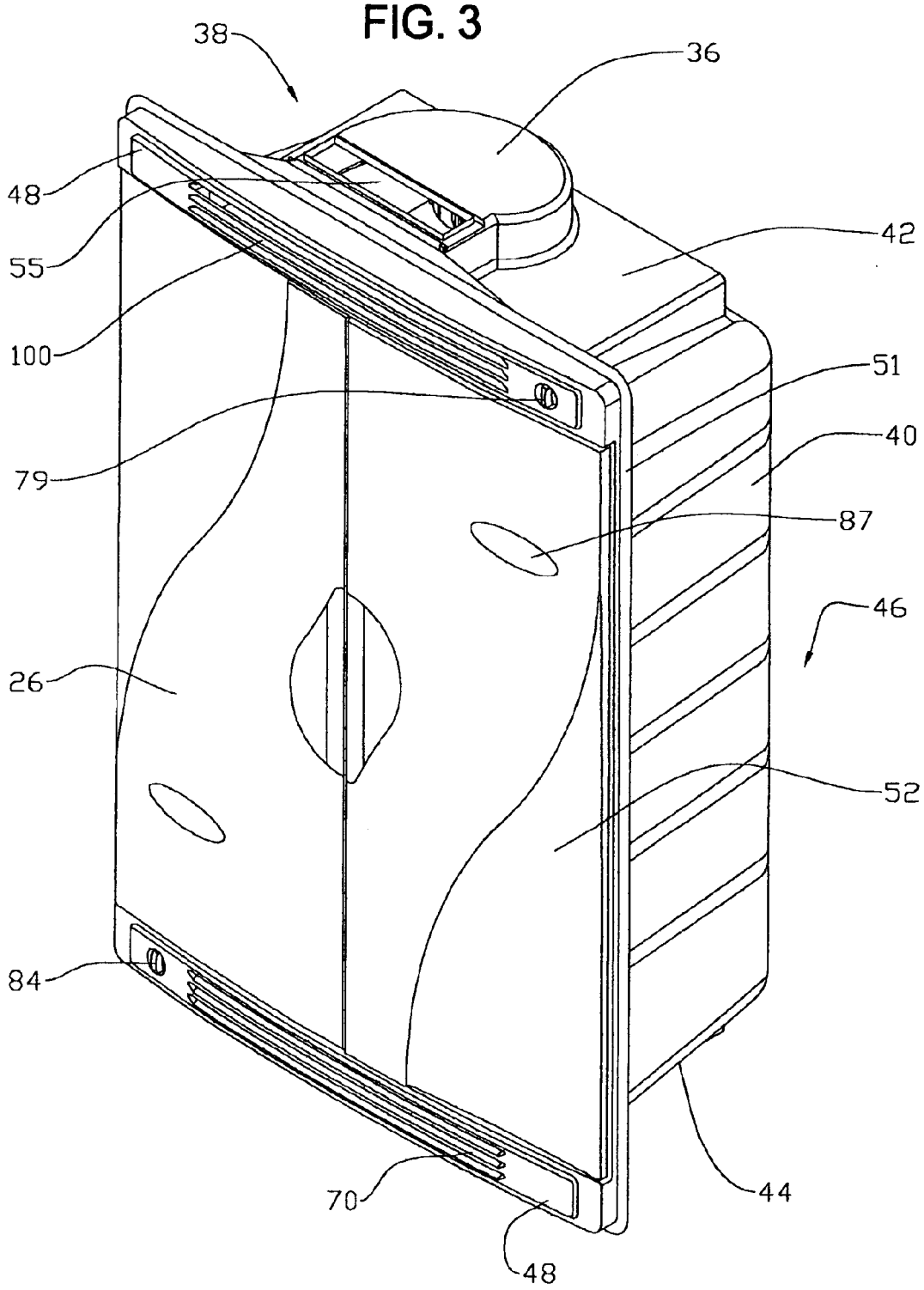
FIG. 3 shows a perspective view of the clothes drying apparatus of the present invention without intake and exhaust passages attached thereto.
Figure 13:
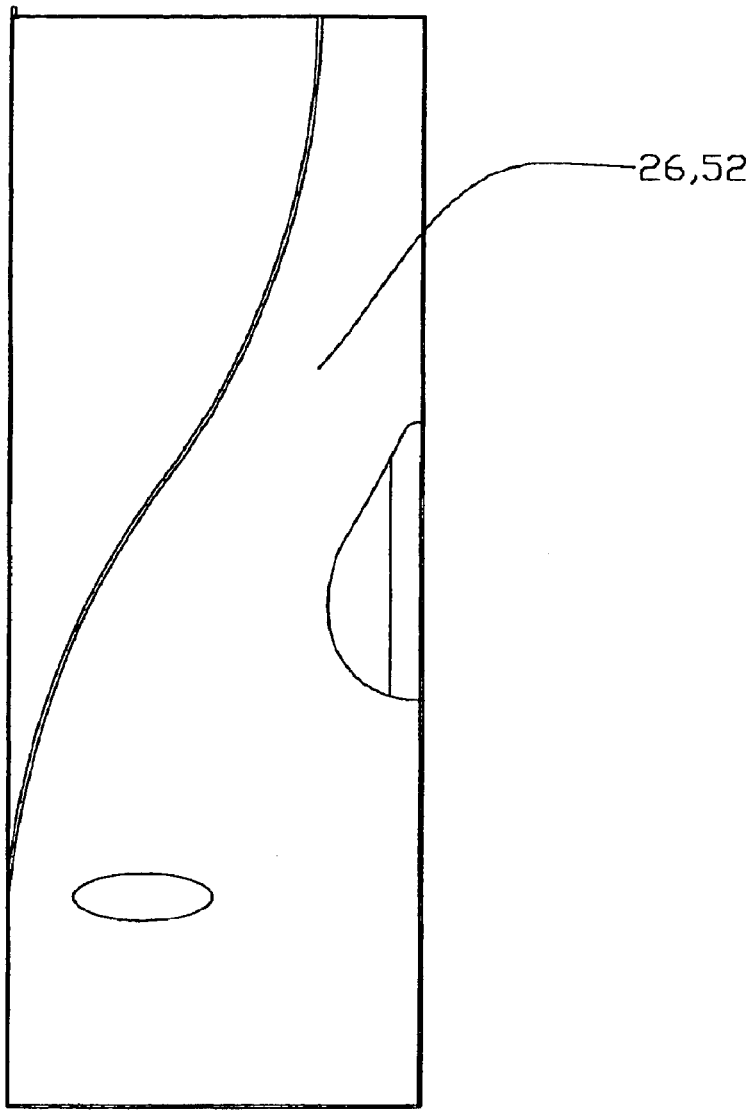
FIG. 13 shows a front view of a door of the clothes drying apparatus of the present invention.
Figure 14:
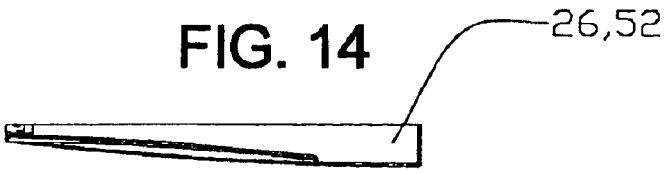
FIG. 14 shows a top view of a door of the clothes drying apparatus of the present invention.

As shown in FIG. 2, the cabinet 22 also has at least one closeable door 26 (see also FIGS. 13, 14) in operable connection with the cabinet 22, allowing access to the interior region 24 of the cabinet 22. The door 26 is hingedly connected to the cabinet 22, and can be opened to gain access to the interior region 24 of the cabinet 22 (See FIG. 5). When the door 26 is closed, it seals the interior region 24 of the cabinet 22 from the exterior environment. While an embodiment having a single door 26 which when closed is in contact with the front edge 49, 51 of the first and second walls 28, 30 is provided, it is contemplated that the door 26 can be placed anywhere on the cabinet 22. Furthermore, the door 26 could comprise a portion of any wall.

Additionally, while one door 26 is capable of being used with the present invention, multiple doors may also be used to allow access to the interior region 24 of the cabinet 22, and to seal the interior region 24 from the exterior environment. FIG. 1 and FIGS. 3–5, provide a clothes drying apparatus, in which a first door 26, and a second door 52, are operably and hingedly connected to the clothes drying cabinet. Doors 26, 52 can be opened and closed together, or individually, to allow access to the interior region 24 of the cabinet 22. Furthermore, it is contemplated that while the first door 26 and the second door 52 may be on the same wall of the cabinet, such an arrangement is not necessary. A door 26 or 52 may be placed on any wall 38, 40, 46 or surface of the cabinet 22 without departing from the scope of the present invention.

Figure 11:
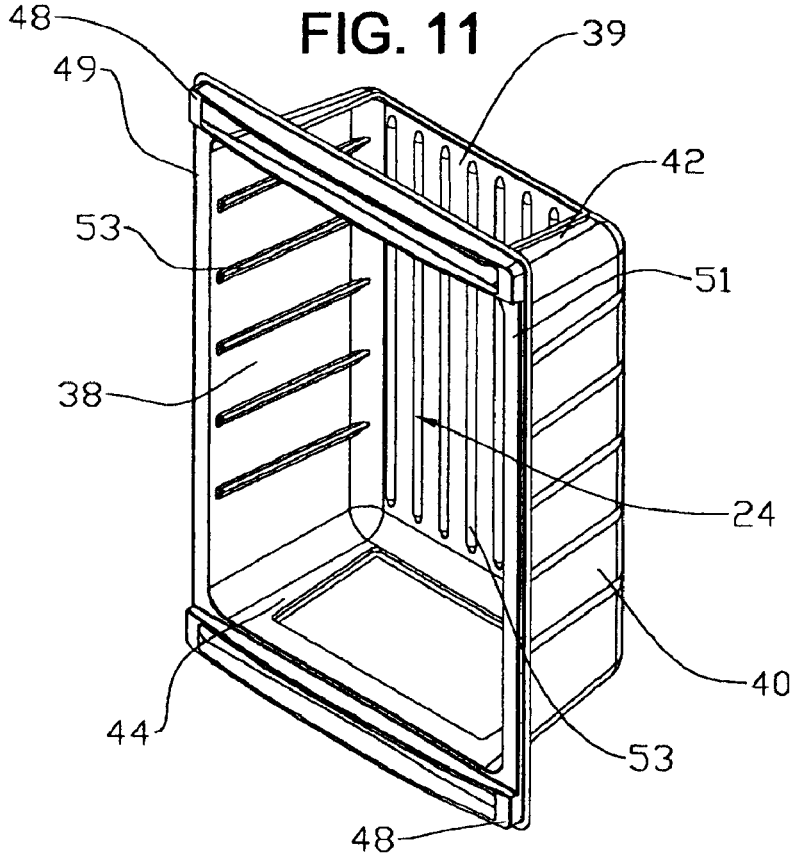
FIG. 11 shows a perspective view of the clothes drying cabinet of the present invention revealing the interior region thereof.
Figure 12:
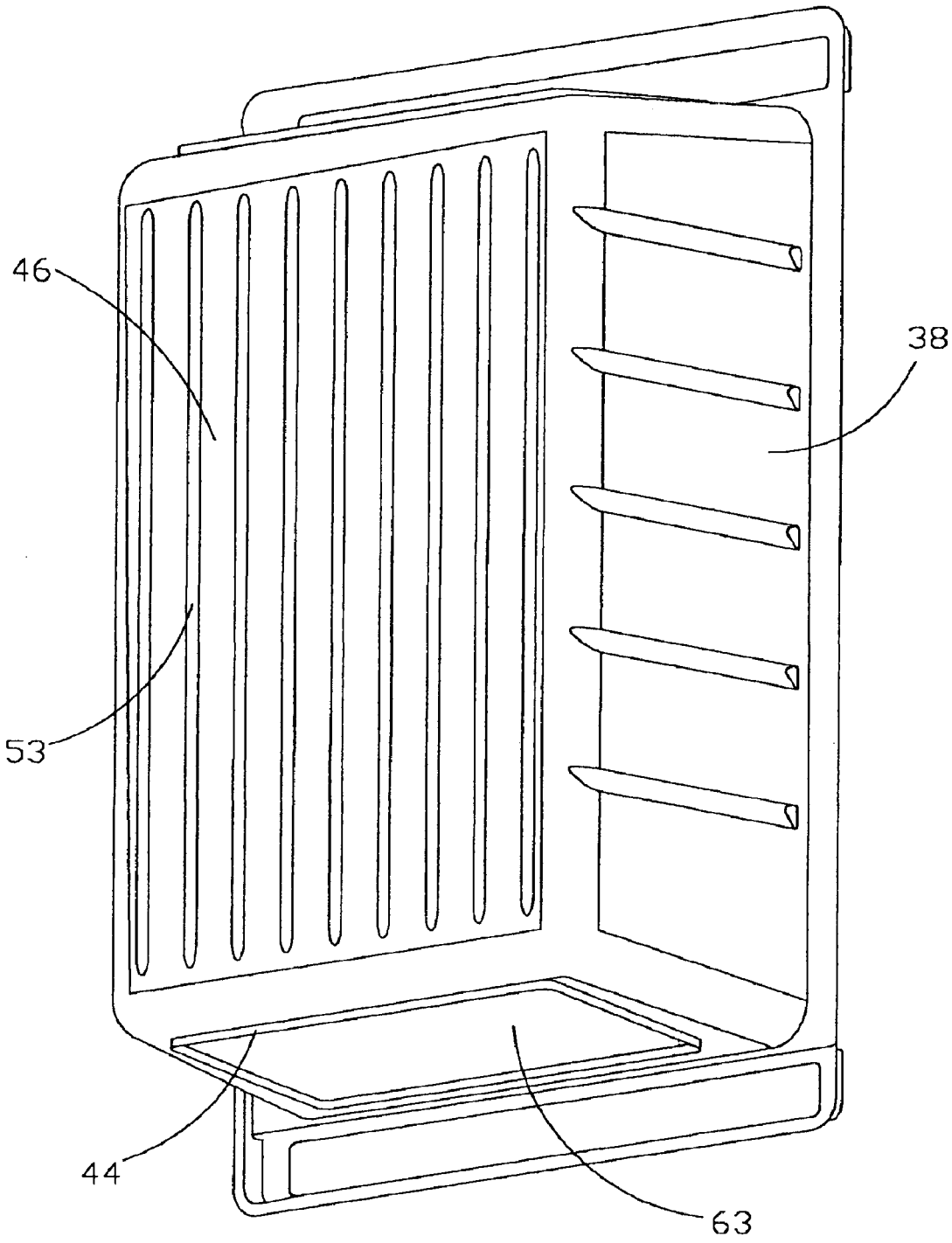
FIG. 12 shows a perspective view of the rear side of the clothes drying cabinet of the present invention.

In a preferred embodiment of the clothes drying cabinet, the first wall 38, second wall 40, and rear wall 46 have a ribbed texture 53 on their surface facing the interior region 24 of the cabinet 22 (See FIGS. 5, 8 and 11). The ribs 53 on the first wall 38 and the second wall 40 are capable of supporting a removable shelf 60. Specifically, multiple ribs 53 on the first wall 38 and the second wall 40 are located at corresponding heights in the cabinet 22. As a result, the removable shelf 60 or multiple removable shelves, can be rested or supported on these ribs 53 at different heights in the cabinet 22. Preferably, these shelves 60 consist of a grate, or contain spaces within the shelf to allow the free flow of air through the shelf 60, so that air circulates freely within the cabinet 22. Additionally, the floor 44 of the cabinet, in one embodiment, contains a drain 50 (FIG. 9) within the interior region 24 of the cabinet 22 for removal of excess water that has dripped onto the floor 44 of the cabinet 22 from the wet clothes received within the cabinet 22. This drain 50 is also operably connected to the exterior of the cabinet, and preferably connected to a drain pipe or waste water line of the building in which the clothes drying apparatus 20 is located, in order to pass the excess water that drips from the wet clothes out of the interior region 24 of the cabinet and into the common waste water removal system of the building.

Figure 15:
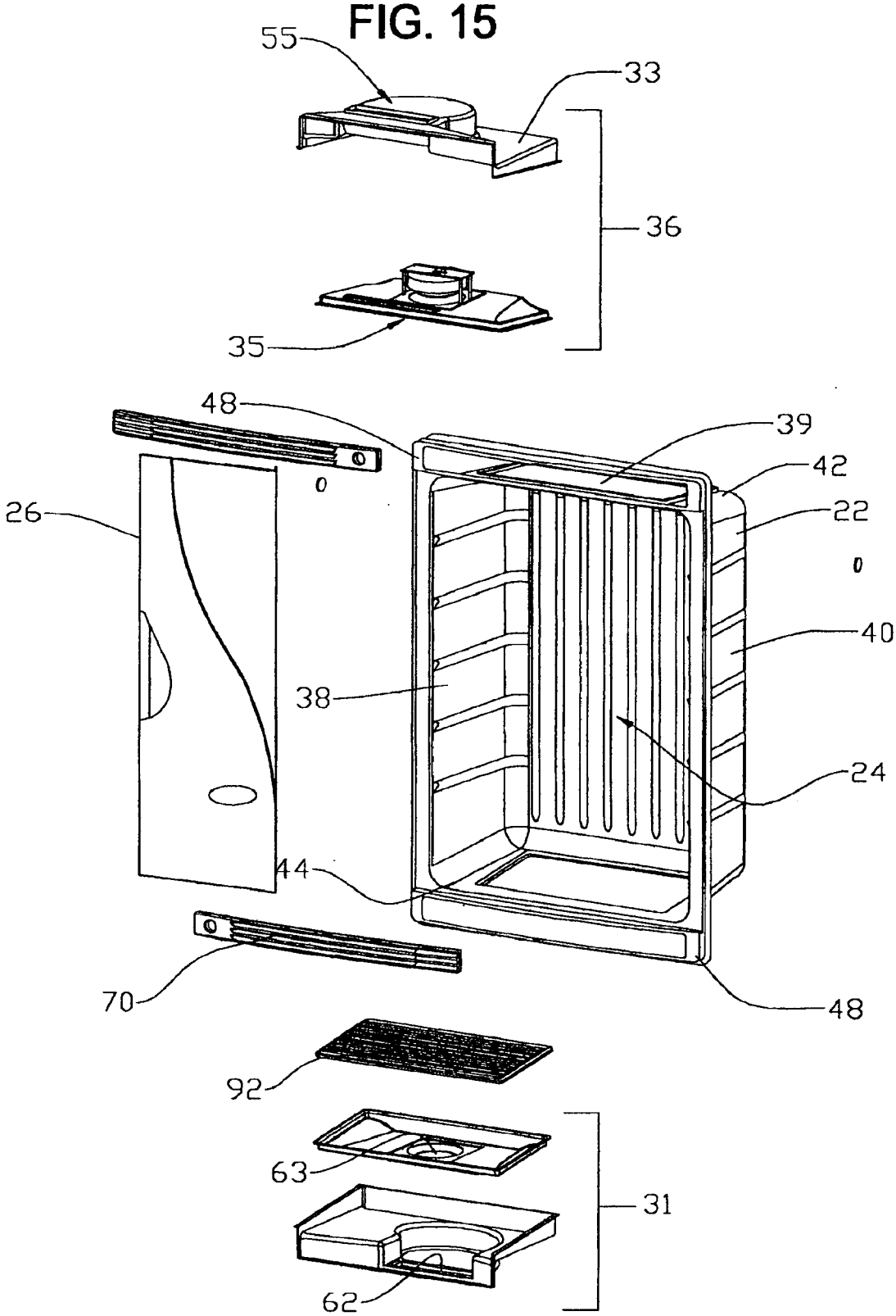
FIG. 15 shows an exploded view of the clothes drying apparatus of the present invention without intake and exhaust passages.

The floor 44 of the cabinet 22 may also contain a filter 92 (FIG. 15). This filter 92 is a screen or other commercially available device inserted into the housing at the floor 44 of the cabinet 22. In this location the filter collects dust, dirt, clothing fibers and other debris that collects in the cabinet and falls to the floor 44. This screen or filter 92, in addition, filters the air that is drawn into the cabinet 22. Namely, due to its location above the first 30 and second 70 intake passages, air drawn into the interior region 24 of the clothes drying apparatus 20 must pass through the filter 92 to reach the interior. Therefore, dust and other debris in the air is collected by the filter 92 as the air passes through. As a result, the air used to dry the clothing received within the apparatus 20 is cleaner than would otherwise be introduced absent such filter.

The clothes drying cabinet 22 of the present invention is constructed of a plastic material, and is of uniform construction. Particularly, the clothes drying cabinet 22 is a molded plastic article formed by vacuum form molding. Vacuum forming the clothes drying cabinet 22 of the present invention involves placing a sheet of suitable plastic material into a molding apparatus. Subsequently, the sheet of plastic material is heated to a temperature that causes the plastic material to be malleable and shapeable. The plastic material is then positioned over the vacuum forming mold cavity, which cavity provides the desired shape of the plastic article—in this case the clothes drying cabinet. The vacuum is then activated, drawing the plastic material into the shape of the mold cavity and pulling the plastic tight into the mold. In some instances, pressure may also be applied to form the plastic molded part. Following vacuum forming the plastic part, the plastic part is cooled and released from the mold chamber. Subsequently, the excess plastic existing on the edge of the plastic article is trimmed. The end result is a plastic clothes drying cabinet 22 of the desired shape and of uniform construction.

In one embodiment of the clothes drying apparatus 20 of the present invention, the clothes drying cabinet 22 is insulated. Preferably, each wall 38, 40, 46, 48, as well as the ceiling 42, floor 44, and door 26, which form the interior region 24 of the cabinet 22, are insulated to provide an efficient seal, and increase the ability to retain or exclude heat and humidity within the interior region 24 of the cabinet 22, thereby adding increased efficiency to the cabinet 22. In one embodiment, insulation is blown on to the outer surface of the cabinet. Alternatively, the insulation 59 may be applied within the wall in which the clothes drying apparatus 20 is installed (See FIG. 18). While specific examples of insulation are provided hereinabove, the invention is not limited thereto. One of ordinary skill in the art with this disclosure before them would understand that any form of insulation would be acceptable for purposes of the present invention.

As shown in FIG. 5, the clothes drying cabinet 22 of the present invention includes a means for holding clothes 54, 60 within the interior region 24 of the cabinet 22. By holding clothes within the cabinet, as opposed to conventional tumbling, the clothes drying apparatus 20 dries clothes without the damage to fabrics caused by conventional tumble dryers. The clothes drying apparatus 20 does not press, stretch, or jostle the clothes placed within the interior region 24 of the cabinet. Instead, the clothes are stationary. In one embodiment, clothes are held on a rod 54 connected to, and extending from, the first wall 38 of the cabinet 22, across the interior region 24 of the cabinet 22, to the second wall 38 of the cabinet 22. As discussed previously, the rod 54 may be supported by the ribs 53 of the cabinet 22. Preferably, the rod 54 is located closer to the ceiling 42 of the interior region 24 of the cabinet 22 than the floor 44. However, one of ordinary skill in the art would understand that any placement of the rod 54 is acceptable for purposes of the present invention. Conventional clothes hangers may be used to hang clothing 93 from this rod 54. Alternatively, clothing 93 can be draped over the rod 54 to dry. While a clothes rod 54 is provided, any conventional apparatus for holding clothes 93 for drying would be acceptable for purposes of the present invention, including, but not limited to, a clothes drying rack, hooks, or shelves 60 (as discussed above) placed within the interior region 24 of the cabinet 22.

In addition to receiving clothes within the clothes drying apparatus 20, footwear 94 may also be received within the interior region 24 of the cabinet 22 (See FIG. 5). For example, shoes, boots, socks, and other items may be dried within the cabinet to obtain a clothesline fresh appearance, feel, and smell for the footwear dried within the cabinet. Specifically, the removable shelves 60 and/or the floor 44 of the cabinet provide sufficient space for the placement and drying of footwear 94 within the cabinet 22.

In order to introduce air into the interior region 24 of the cabinet 22 to dry clothes placed within the apparatus 20, a first intake passage 30 is attached to the clothes drying cabinet 22. The first intake passage 30 is a means through which air, particularly, ambient air, can pass from the exterior environment of a building 34 to the interior region 24 of the cabinet 22. More particularly, the first intake passage 30 provides a conduit for the passage of air into the cabinet 22 from the outdoors 34, in order to circulate that fresh air in the interior region 24 of the cabinet 22 to dry the clothes, while providing a clothesline fresh appearance, feel, and smell to those clothes dried within the cabinet.

Figure 16:
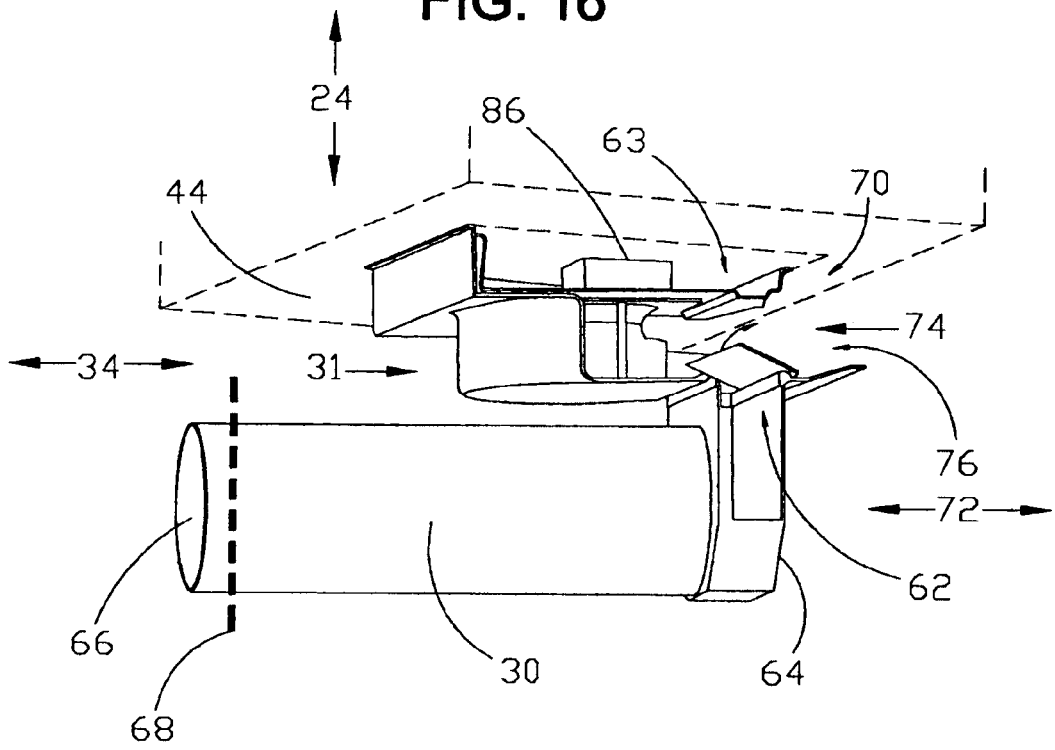
FIG. 16 shows a cut away view of an embodiment of the intake assembly of the present invention.

As shown in FIG. 16, the first intake passage 30 has a first end 64, and a second end 66 opposite the first end 64. The first passage 30 is a duct attached to either a wall 38, 40, 46, 48, the ceiling 42, or the floor 44 of the cabinet by a linking assembly 31. The first end 64 of the first intake passage 30, or duct, extends through a first access gate 62 provided in the linking assembly 31 which is attached to the floor 44 of the cabinet. This linking assembly 31 also has a second access gate 63 opposite this attachment, providing access into the interior region 24 of the cabinet 22. The second end 66 of the first intake passage 30 is connected to an opening in or passes through the outer wall 68 of a building, so that the first intake passage 30 accesses the outdoors 34. As a result, air can be drawn from the exterior environment of a building 34, passed through the first intake passage 30, and circulated into the interior region 24 of the cabinet 22 of the clothes drying apparatus 20.

Figure 18:
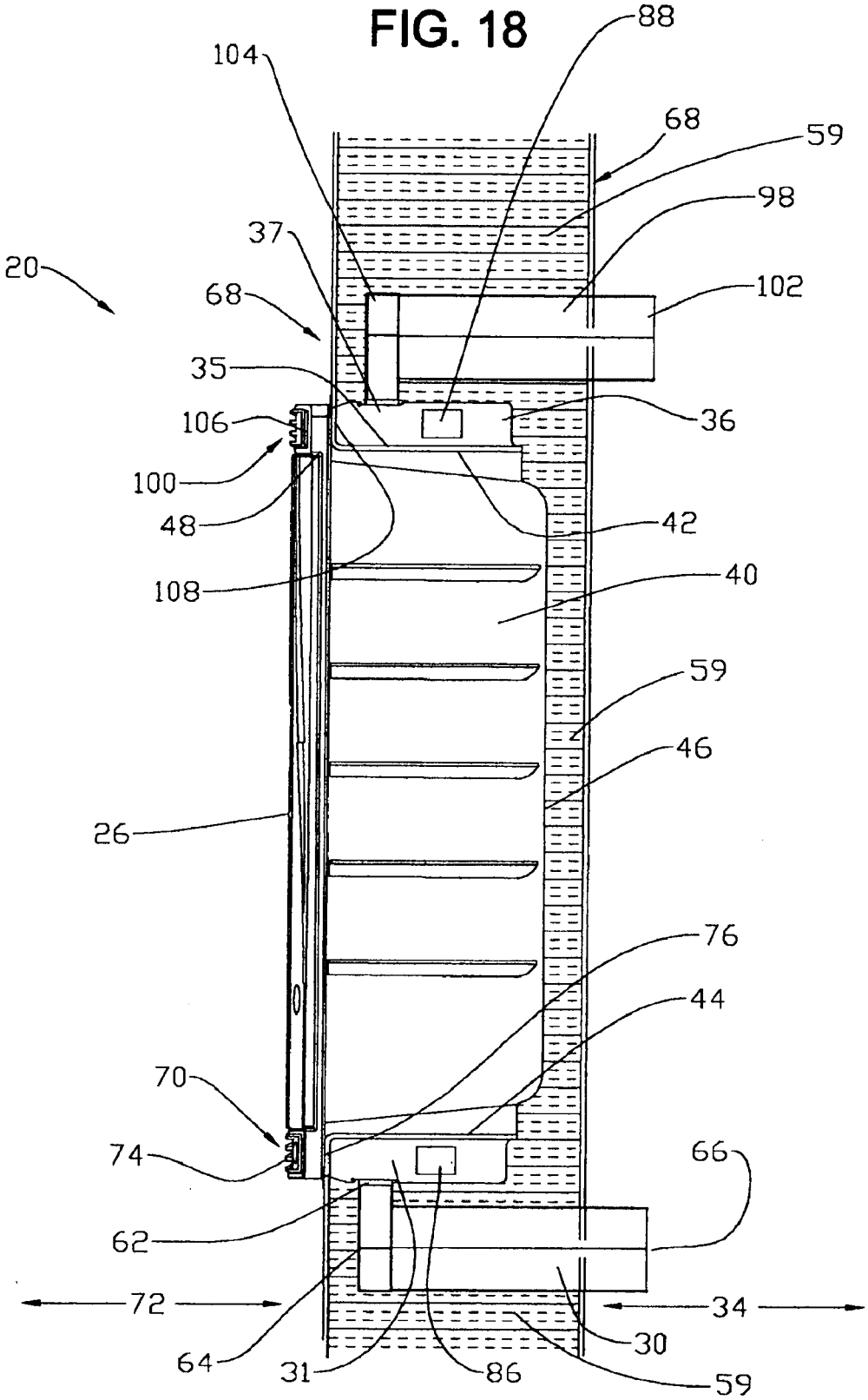
FIG. 18 shows a side view of an embodiment of the clothes drying apparatus of the present invention attached to a wall having insulation.

In addition to the first intake passage 30, one embodiment of the present invention also includes a second intake passage 70 attached to the clothes drying cabinet 22 through the linking assembly 31. Contrary to the first intake passage 30, the second intake passage 70 links the interior environment of a building 72 with the interior region 24 of the cabinet 22. The second intake passage 70 is an inlet attached to either a wall 38, 40, 46, 48, the ceiling 42, or the floor 44 of the cabinet 22. In the preferred embodiment, this inlet is a slotted vent 70 located at the bottom of the apparatus 20, on the front face 48 thereof. The second intake passage 70 has a first end 74 and a second end 76 opposite the first end 74. Referring to FIG. 18, the first end 74 of the second intake passage 70 is located at an opening to the exterior of the clothes drying apparatus 20, (i.e., the front face 48,) so that the first end 74 of the second intake passage 70 is within the interior environment of a building 72 or room in which the cabinet 22 is located. While an opening in the front face 48 of the cabinet is specifically described, other openings, passages, and/or ducts are contemplated by the present invention. For instance, it is contemplated that the second intake passage 70 may be a duct extending directly through the wall of the cabinet 22 in order to access the interior region 24.

The second end 76 of the second intake passage 70 extends into the linking assembly 31 which, in turn, accesses the interior region 24 of the cabinet 22 through a first access gate 63, so that the second end 76 of the second intake passage 70 provides access to the interior region 24 of the cabinet 22. Thus, by operation of the vacuum unit 36, air is drawn from indoors 72, through the second intake passage 70, and circulated into the interior region 24 of the clothes drying apparatus 20 to dry the clothes received within the cabinet 22.

Figure 17:
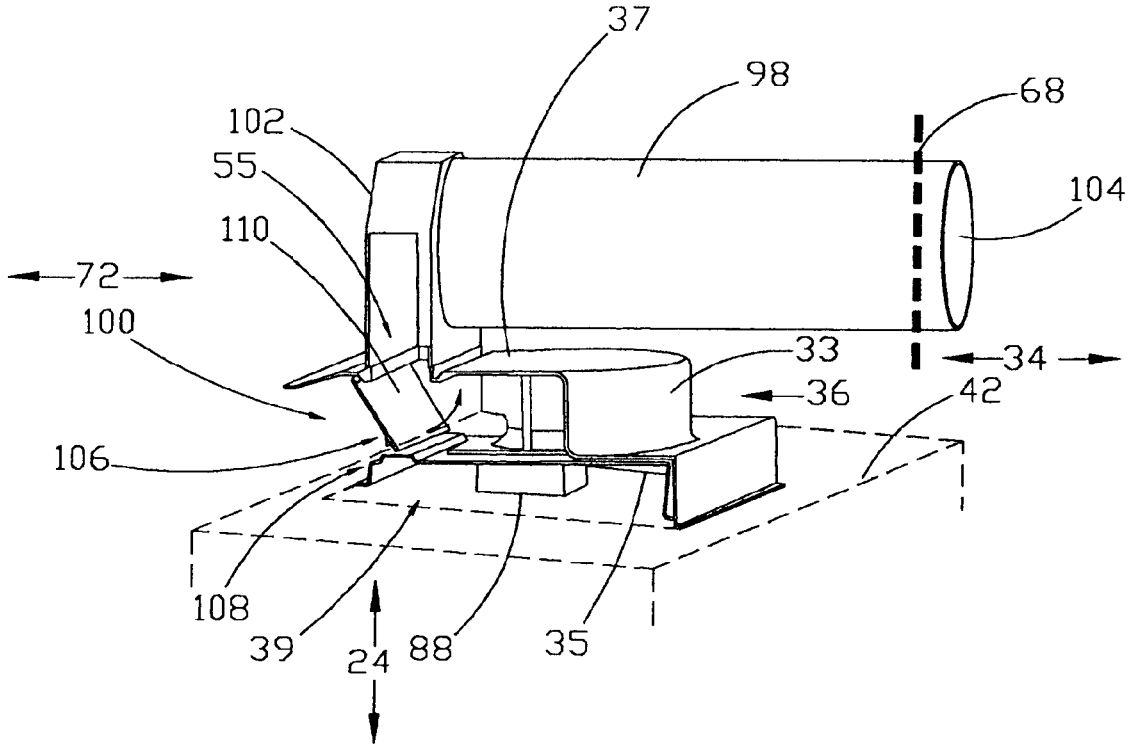
FIG. 17 shows a cut away view of an embodiment of the exhaust assembly of the present invention.

Like the first and second intake passages 30, 70, a preferred embodiment of the clothes drying apparatus also contains a first 98 and a second 100 exhaust passage (FIG. 17). As a result, the clothes drying apparatus 20, or operator thereof, can selectively exhaust air from the apparatus 20 outdoors 34, or into the room 72, building, or structure in which the apparatus 20 is located. The first exhaust passage 98 is preferably a duct through which exhausted air can pass from the interior region 24 of the cabinet 22 to the outdoors 34. The first exhaust passage 98 has a first end 102, and a second end 104 opposite the first end 102. The first exhaust passage 98 is preferably attached to the vacuum unit 36 at the second side 37 thereof. The first end 102 of the first exhaust passage 98 extends through the second vacuum access gate 55 provided in the vacuum unit 36, which is attached to the ceiling 42 of the cabinet 22. The vacuum unit 36 also has a first vacuum access gate 39 opposite this attachment, providing access from the interior region 24 of the cabinet 22. The second end 104 of the first exhaust passage 98 is connected to an opening in or passes through the outer wall 68 of a building, so that the first exhaust passage 98 exhausts to the outdoors. As a result, air can be drawn from the interior region 24 of the cabinet 22, through the vacuum unit 36, passed through the first exhaust passage 98, and expelled outdoors 34.

In addition to the first exhaust passage 98, one embodiment of the present invention also includes a second exhaust passage 100 attached to the clothes drying cabinet 22 through the vacuum unit 36. Contrary to the first exhaust passage 98, the second exhaust passage 100 provides a conduit for the expulsion of air out of the interior region 24 of the cabinet 22 and into the interior of a building 72. The second exhaust passage 100 is an outlet attached to either a wall 38, 40, 46, 48, the ceiling 42, or the floor 44 of the cabinet 22. In the preferred embodiment, this outlet is a slotted vent located at the top of the clothes drying apparatus 20, on the front face 48 thereof (See FIG. 18). The second exhaust passage 100 has a first end 106 and a second end 108 opposite the first end 106. The first end 106 of the second exhaust passage 100 extends into the vacuum unit 36 which, in turn, accesses the interior region 24 of the cabinet 22 through a first vacuum access gate 39. The second end 108 of the second exhaust passage 100 is located at an opening to the exterior of the clothes drying apparatus 20, i.e., the front face 48, so that the second end 108 of the second exhaust passage 100 is within the interior environment of a building 72 in which the cabinet is located. While an opening in the front face 48 of the clothes drying apparatus 20 is specifically described, other openings, passages and/or ducts are contemplated by the present invention. For instance, it is contemplated that the second exhaust passage 100 may be a duct extending directly through the wall of the cabinet 22 in order to access the interior region 24. Accordingly, by operation of the vacuum unit, air is drawn from the interior region 24 of the cabinet 22, through the vacuum unit 36, passed through the second exhaust passage 100, and expelled indoors.

In a preferred embodiment, the first intake passage 30 and the second intake passage 70, as well as the first 98 and second 100 exhaust passages are each closeable. In order to close the respective passage, a switching mechanism 78 or 10 rotates from one passage to the next, based on the operator's choice to close same. It is contemplated that each individual passage 30, 70, 98, 100 may be separately closeable. In other words, each passage would have its own closing means so that each passage is capable of being opened or closed simultaneously. As a result, for example, the first intake passage 30 may be opened to access air from the outdoors 34 while the second intake passage 70 is closed, keeping air from indoors 72 out of the cabinet 22. Alternatively, the second intake passage 70 may be opened to access air from indoors 72 while the first intake passage 30 is closed, keeping air from the exterior environment of a building 34 out of the cabinet 22. Preferably, the first intake passage 30 and the second intake passage 70 are selectively opened or closed depending on the relative temperature and humidity outside of the clothes drying cabinet 22. Generally, the first 98 and second 100 exhaust passages may be opened in the same manner to selectively choose to exhaust air outdoors or indoors.

As a non-limiting example discussed previously, humidity has an effect on the length of time necessary to dry clothes. The more humidity or moisture in the air, the more difficult it is to dry wet clothing because the air is already saturated with moisture. High humidity leads to increased drying times. It is also understood that, typically, air will be much drier, or less humid inside a building, particularly if the building is air conditioned. Therefore, in order to avoid a lengthy drying time on a day of high humidity, the clothes drying apparatus 20 is operated with the first intake passage 30 in the closed position and the second intake passage 70 in the open position, so that air is drawn from the less humid air that exists in the interior environment of a building 72. In other words, the intake switching mechanism 78 is rotated to close the first intake passage 30 which, at the same time, opens the second intake passage 70, thereby sealing the clothes drying cabinet from the exterior or outdoor environmental conditions, and opening access to the indoor environment. As a result, high humidity outdoors will not affect the drying time of the clothes received within the cabinet. The opposite situation may also occur. For example, in some situations it may be more efficient to draw air from the exterior environment of a building 34. Alternatively, days on which the temperature is too cold to effectively remove water from wet clothing, the apparatus 20 may be operated to draw the warm air from the interior environment of a building 72. Likewise, for various reasons, an operator may choose to exhaust air indoors or outdoors, and consequently will rotate the exhaust switching mechanism 110 to correspond with same. For example, on a cold day, the operator may choose to exhaust air indoors to avoid opening any link to the colder environmental conditions outdoors.

As discussed above, to alternatively open and close the first 30 and second 70 intake passages, the intake passages are operably connected to an intake switching mechanism 78. The intake switching mechanism 78 is a flap, switch, plate, or other object pivotally and hingedly connected at one end to the surface of either a wall of the cabinet 22 or the linking assembly 31 (See FIG. 16). This intake switching mechanism 78 is operably connected to an intake control knob 84 (See FIG. 4). Rotation of the intake control knob 84 pivots the intake switching mechanism 78 to block the flow of air from the first intake passage 30 or the second intake passage 70. As the intake switching mechanism 78 links both intake passages 30, 70 together, rotation of the intake control knob 84, allows for engagement and switching between the first intake passage 30 and the second intake passage 70, to draw air from either the exterior environment of a building 34 or the interior environment of a building 72 (See FIGS. 4, 16). While the control unit 84 is referred to as a control knob hereinabove, it is contemplated that a computer, central processing unit (CPU), or other electronic or digital device could provide signals to engage and disengage the intake switching mechanism 78 of the present invention. Thus, the signal to open a passage by the control unit 84 may be triggered by hand, or may be controlled automatically, such as by a programmable computer.

Figure 4:
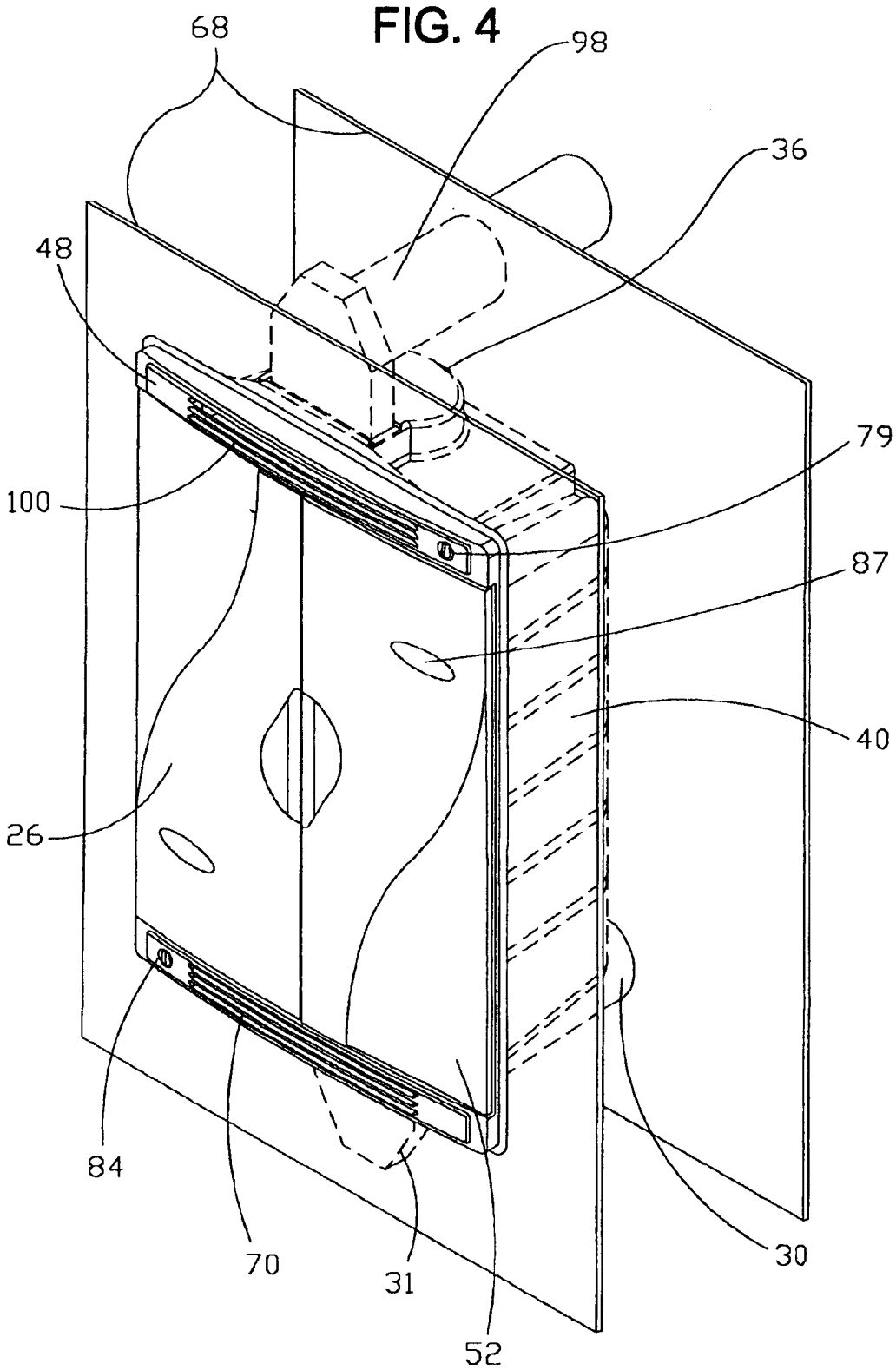
FIG. 4 shows a perspective view of the clothes drying apparatus of the present invention and attachment of same to a wall.

Similar to the intake switching mechanism 78, the exhaust switching mechanism 110 is operated by rotation of an exhaust control knob 79 operably connected to the exhaust switching mechanism 110 (See FIG. 4). The exhaust switching mechanism 110, likewise, is a flap, switch, plate, or other object pivotally and hingedly connected at one end to the surface of either a wall of the cabinet 22 or the vacuum assembly 36 (see FIG. 17). As the exhaust control knob 79 is rotated, the second switching mechanism 110 rotates to seal off either the first exhaust passage 98 or the second exhaust passage 100, so as to channel the exhausted air either out of the building or into the room in which the cabinet 22 is located (See FIG. 17). As discussed with respect to the intake control 84, while manual operation is specifically discussed, it is contemplated that electronic and/or digital control of the exhaust switching mechanism 110 is also acceptable for purposes of the present invention.

Accordingly, upon receipt of the signal from the control unit, or rotation of the intake control knob 84, (and/or exhaust control knob 79) the intake switching mechanism 78 (and/or exhaust switching mechanism) engages one of the first 30 or second 70 passages (exhaust passages 98 and 100), and mechanically opens or closes the desired passage. As a result, air is drawn into the interior region 24 of the cabinet 22 through the open passage designated by the intake control knob 84 and exhausted from the cabinet 22 through the open passage designated by the exhaust control knob 79.

In addition to a first intake passage 30 and a second intake passage 70, a vacuum unit 36 is attached to the clothes drying cabinet 22. Preferably, the vacuum unit 36 is attached to the ceiling 42 of the cabinet 22 (See FIGS. 3–5, 7, 15 and 18). The vacuum unit 36 comprises a fan/blower assembly within a housing 33 (FIGS. 7, 15). Such fans are commercially available from EBM Industries, Inc. of Farmington, Conn. The vacuum unit 36, in operation, draws air from the outdoors 34, through the first intake passage 30, and into the interior region 24 of the cabinet 22. The air is drawn into the vacuum unit 36 from the interior region 24 and exhausted from the cabinet 22. Similar to the intake assembly 31, while attachment to the ceiling is specifically mentioned, the vacuum unit 36 may also be attached to any wall 38, 40, 46, 48 of the cabinet, or alternatively can be attached to the floor 44 of the cabinet 22 if so desired. As seen in FIG. 17, the vacuum unit 36 is attached to the cabinet 22 with a first side 35 of the vacuum unit 36 accessing the interior region 24 of the cabinet 22 through a vacuum access gate 39. A second side 37 of the vacuum unit 36 accesses the exterior of the cabinet 22 through a second vacuum access gate 55. The vacuum unit 36 is oriented so that air located in the interior region 24 of the cabinet 22 is drawn out of the cabinet 22 through the first side 35 of the vacuum unit 36, and then exhausted to the exterior of the apparatus 20 through the second side 37 of the vacuum unit 36 when in operation. Additionally, the vacuum unit 36, so oriented, is operably attached to the clothes drying apparatus 20 to draw air into the interior region 24 of the cabinet 22 when an opening in the interior region 24 of the cabinet is provided. In combination with the exhausting of air from the interior region 24 of the clothes drying cabinet 22, the drawing of air from the exterior of the cabinet 22 provides a constant cycle of fresh air that is used to dry clothes, providing a clothesline fresh appearance, feel, and smell to the clothes dried within the apparatus 20.

Preferably, the vacuum unit 36 is further attached to the first 98 and second 100 exhaust passages (See FIGS. 17, 18). In the preferred embodiment, an exhaust switching mechanism 110 is also provided within the vacuum unit 36 to channel air exhausted out of the cabinet either into the interior of a building 72 or outdoors 34 based on the operator's preference. As discussed above, the exhaust switching mechanism 10, similar to the intake switching mechanism 78, is hingedly and rotatably connected to a wall of the vacuum housing 33. As a result, the switching mechanism can rotate to close the exhaust passage, exhausting to the interior of a building 72 or outdoors 34 with minimal effort.

The operation of the vacuum unit 36 causes movement and circulation of the air within the interior region 24 of the cabinet 22, creating a flow of air across the clothing received within the cabinet until the air is drawn into the vacuum unit 36 on the first side 35 and exhausted out of the apparatus 20 at the second side 37 of the vacuum unit 36 through the first passage 30. Thus, when the first intake passage 30 is attached to the cabinet 22, the operation of the vacuum unit 36 dries clothes with fresh air from the exterior environment of a building 34, which results in a clothesline fresh appearance, feel, and smell to those clothes dried within the clothes drying apparatus 20.

In a preferred embodiment, a signal is communicated by the intake control knob 84 to the intake switching mechanism 78 based upon the relative outdoor humidity and temperature either through manual operation, or electronically. In one embodiment, a sensor 86 or other device connected to the control unit 84, monitors temperature and humidity as discussed in more detail hereinbelow. To use the previous example, at an elevated level of outdoor humidity, in order to avoid drawing hot and humid air from outdoors 34 to dry the clothes within the cabinet 22, after a manual or automatic command is received, a signal is sent to the intake switching mechanism 78 to close the first intake passage 30. Closing the first intake passage 30 cuts off the supply of air from outdoors 34. The control knob 84 also simultaneously signals to the intake switching mechanism 78 that the second intake passage 70 will remain in the open position, i.e., the intake switching mechanism does not engage the second intake passage 70. As a result, when the vacuum unit 36 is operated after the intake switching mechanism 78 has been engaged, air is drawn into the interior region 24 of the cabinet 22 through the open passage, in this case, from indoors 72. Accordingly, the control means 84 signals the clothes drying apparatus 20 to draw air from the interior environment of a building 72, through the second intake passage 70, and into the interior region 24 of the cabinet 22, resulting in less humid air being introduced into the interior region 24 of the cabinet, decreasing drying time and increasing dryer efficiency.

As mentioned hereinabove, provided in one embodiment of the clothes drying apparatus 20 is a first sensor 86 operably connected to the control unit 84 (See FIGS. 16, 18 and 21). A sensor, as described herein, is a device used to detect values or changes in physical quantities, and converts same into a useful input signal for an information-gathering system, such as a programmable central processing unit (CPU). The sensors in the preferred embodiment are commercially available devices, available from Humirel, Inc. of Phoenix, Ariz., and are essentially a one (1) inch by one (1) inch square component linked to and in communication with the programmable control 84. The first sensor 86 detects and provides an indicator of temperature and humidity values. The first sensor 86, in one embodiment, is attached to the housing or wall 38, 40, 46, 48, ceiling 42, or floor 44, of the clothes drying cabinet 22 within the interior region 24 (See FIG. 5). In this location, the first sensor 86 monitors temperature and humidity levels within the cabinet 22.

An alternative embodiment involves the use of two (2) sensors (FIGS. 16–18). Specifically, a first sensor 86 is provided in the intake duct work or linking assembly 31 (FIG. 16). As a result, the first sensor 86 can monitor outdoor 34 temperature and humidity, as well as the temperature and humidity of the air drawn across the sensor and into the cabinet 22. Likewise, within the linking assembly 31, the first sensor 86 may also monitor the air drawn into the cabinet or permeating into the cabinet from the interior environment 72. In addition to, or in place of, a sensor located within the linking assembly 31, it is further contemplated that one or more of these sensors can be placed directly within the first 30 and/or second 70 intake passage without departing from the overall scope of the present invention.

The second sensor 88 may be provided in the exhaust portion of the device 20. Namely, the second sensor 88 is preferably located in the vacuum unit 36 housing, or in the first and/or second exhaust passages 98, 100 (FIG. 17). The second sensor 88 is comparable to the first sensor in terms of structure and function. The location of the second sensor 88 allows for monitoring the temperature and humidity exhausted from the clothes drying apparatus 20. In particular, the moisture removed from the clothing placed inside the cabinet is monitored by the second sensor 88. As air is drawn out of the cabinet 22 and over the second sensor 88, the second sensor 88 detects the moisture in the air which corresponds to the moisture removed from the clothing. When the moisture and/or humidity being exhausted from the cabinet and detected by the second sensor 88 reaches a specified level, for example, the humidity drops to near zero (0), a signal is sent to stop the clothes drying apparatus 20. It is contemplated that any variable or value would be acceptable for purposes of the present invention.

In one embodiment, the first sensor 86 is directly or indirectly connected to the intake switching mechanism 78 through the intake control unit 84. The second sensor 88, if used, may also be indirectly connected to the exhaust switching mechanism 10 through a second control unit 79. The first sensor 86 and second sensor 88 monitor or detect a variable value, and communicate these detected values to a programmable CPU in operable communication with the control units 79, 84. In particular, a value limit described above, is set and programmed into the CPU. The value limit entered into the CPU corresponds to a value indicated by the operator to be a triggering value. Referring specifically to the intake system, this variable value limit is set by an operator who enters a number value into a programmable interface 87 of the control unit 84. The first sensor 86 continually monitors the variable and communicates the variable value to the CPU. When the variable reaches the value limit established in the CPU, by electronic signal, the control knob 84 is operated to rotate the attached intake switching mechanism 78 and closes the respective intake passage 30, 70. In the preferred embodiment, the CPU is provided with a designated variable value limit, at which value the control means 84 is triggered to send a signal to the intake switching mechanism 78 to close one of the closeable passages 30, 70. The signal may be in the form of an alert for the operator, who manually switches the device, or may be an electronic signal or communication from the CPU to the control unit 84. Thus, upon receipt of the signal, the intake switching mechanism 78 closes the first 30 or second 70 passage.

Figure 19:
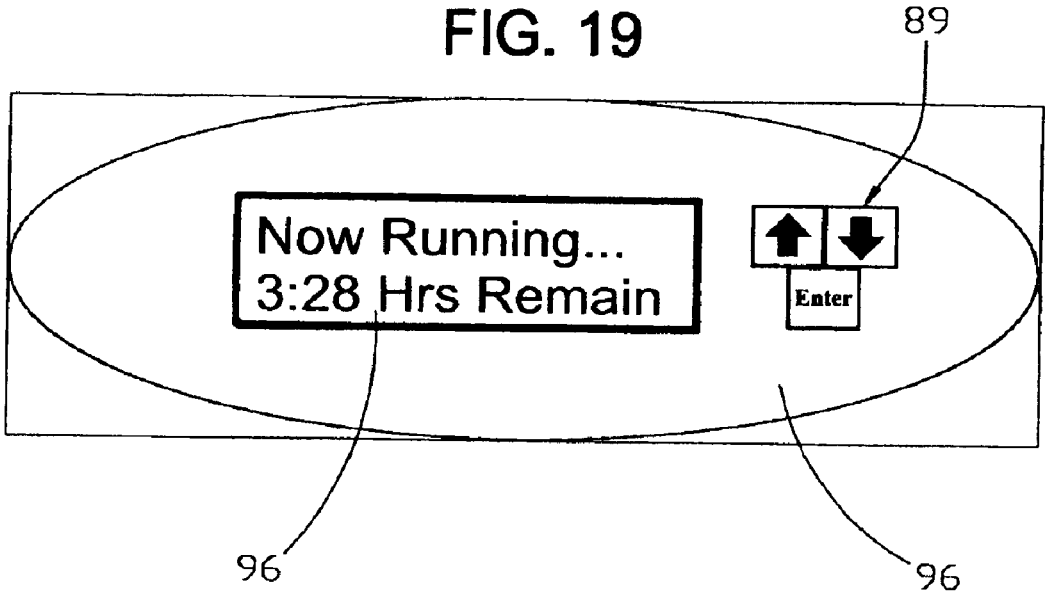
FIG. 19 shows an embodiment of a programmable interface and corresponding display of the clothes drying apparatus of the present invention.
Figure 20:
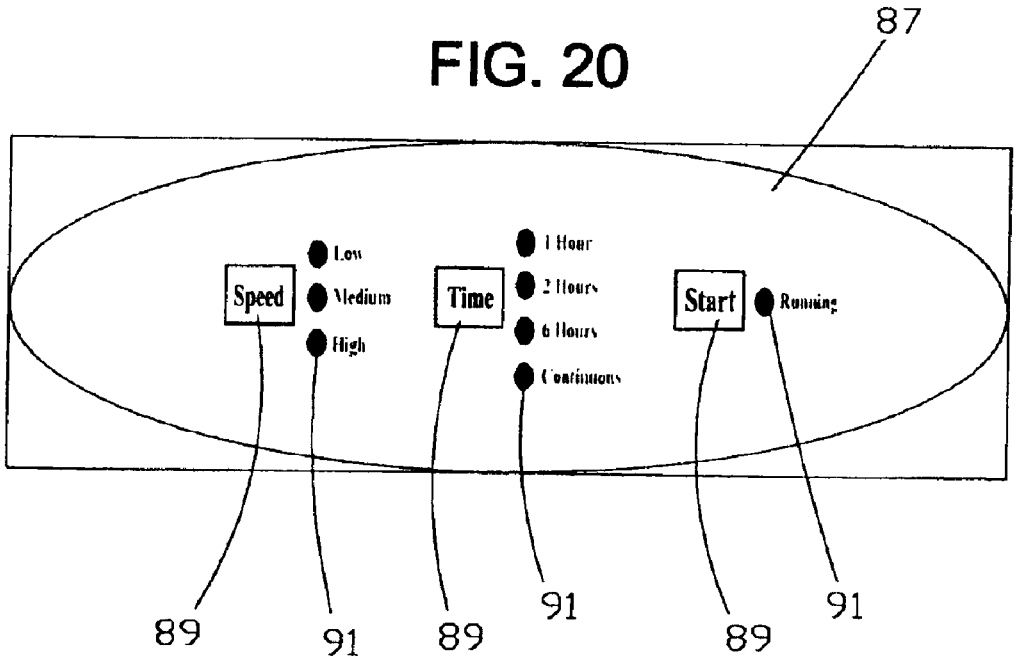
FIG. 20 shows an embodiment of a programmable interface of the clothes drying apparatus of the present invention.

In the preferred embodiment, the CPU is a programmable interface 87 (See FIGS. 1, 19 and 20). The programmable interface 87 is a control board located on the front face 48 of the apparatus 20, and preferably on the door 26 or 52 of same. This programmable interface 87 consists of one or more function keys 89 corresponding to preset settings, and a corresponding LED light 91 or display to indicate the selected setting. Alternatively, a programmable CPU with an LCD screen may be used to monitor and enter values, including, but not limited to, a personal computer operating a commercially available software program. While many settings are contemplated by the present invention, the simplest system comprises settings or functions for time, blower speed, and start or on/off. Other functions, such as monitored humidity and/or temperature settings may also be included.

Preferably, the correlation between the variable value detected by the first sensor 86 and the set value limit indicate to the CPU that a variable element has reached a value that would be inefficient for drying clothes. In a preferred embodiment, the variable value is a temperature or a relative humidity. For example, the value limit for humidity may be the value at which the outside air is saturated with moisture, which would result in an extensive period of time to dry clothes. However, any value acceptable for an operator's purposes in drying clothes would be acceptable for purposes of the present invention. Likewise, it is contemplated that any variable condition or physical quantity chosen to assist in monitoring the process of drying clothes would be acceptable for purposes of the present invention, including, but not limited to: temperature and time.

In one embodiment, a value limit is entered into the programmable interface 87. The limit is associated with dry clothes. Value limits are set as described hereinabove with respect to the first sensor 86. The second sensor 88 detects and monitors the variable values in the interior region 24 of the cabinet 22 or being exhausted from the cabinet and communicates those values to the CPU. When the value reaches the set value limit which has been entered into the CPU, the CPU triggers the vacuum unit 36 to shut off. As discussed hereinabove, this trigger may be an alert to an operator to manually shut off the device, or an electronic signal sent to the vacuum unit 36 indicating that the vacuum is to cease operation. Subsequently, the vacuum unit 36 shuts off, thereby stopping the flow of air into the cabinet 22. As a result, any potential damage that could be caused to clothes by the continued flow of air into the interior region 24 of the cabinet 22 is avoided. Additionally, energy is conserved as the clothes drying apparatus ceases operation when the designated signal is received.

While the clothes drying apparatus 20 draws air from the exterior environment of a building 34, and as a result provides a clothesline fresh appearance, feel, and smell to clothes dried within the cabinet, it is also contemplated that an air freshener may be used, in combination with the air drawn into the interior region 24 of the cabinet 22, to aid in providing a pleasant scent to the clothing dried within the clothes drying apparatus 20. In a preferred embodiment, this air freshener is a commercially available device or chemical that is sprayed onto the surface of the filter 92 in the floor 44 of the clothes drying apparatus 20, although any conventional air freshener would be acceptable for purposes of the present invention.

A method of drying clothes with the clothes drying apparatus 20 of the present invention is also provided, which comprises providing a cabinet 22 defining an interior region 24 for receiving clothes 93. Additionally, one or more doors 26, 52 are provided which are operably and hingedly connected to the cabinet 22, allowing access to the interior region 24 thereof. An article of clothing 93 is placed inside the interior region 24 of the cabinet 22. Once the article of clothing is placed within the interior region 24 of the cabinet, the doors 26, 52 are closed to enclose the article of clothing within the cabinet 22. The interior region 24 of the cabinet 22 is linked to the exterior environment of a building 34 by the attachment of a first intake passage 30. A vacuum unit 36 for drawing air from outdoors 34 into the interior region 24 of the cabinet 22 is also provided in operable engagement with the cabinet 22.

In order to dry clothing placed within the interior region 24 of the cabinet, as described above, the vacuum unit 36 is activated. Specifically, a command is entered by an operator into the programmable interface 87 of the clothes drying apparatus 20 (See FIGS. 19 and 20). This command signals the vacuum to activate, thereby drawing air into the cabinet 22. At this time the operator may set other variable values, or limits, by entering specified values into the CPU or programmable interface 87. The vacuum 36 draws air from an opening in the cabinet 22, in this case, the first intake passage 30. As a result, operation of the vacuum unit 36 draws air into the interior region 24 of the cabinet 22 from outdoors through the first intake passage 30. Air is then circulated within the interior region 24 of the cabinet 22 by continued operation of the vacuum unit 36. This circulated air picks up moisture from within the cabinet and then exhausts same out of the clothes drying apparatus 20 through the vacuum unit 36. The intake and expulsion of air is continuous so that a constant flow of fresh air is introduced into the clothes drying apparatus 20. As a result, moisture is removed from the clothing received within the cabinet 22 thereby drying the clothes, while at the same time providing a clothesline fresh appearance, feel, and smell to the clothes dried within the clothes drying apparatus 20.

One embodiment of the present invention comprises a second intake passage 70 attached to the cabinet 22 (FIGS. 4, 15, 16 and 18). This second intake passage 70 links the interior region 24 of the cabinet 22 to the interior environment of a building 72 in which the clothes drying apparatus 20 is located. Particularly, the second intake passage 70 provides an opening through which air can pass from indoors 72 into the interior region 24 of the cabinet 22. An intake switching mechanism 78 is also provided in operable connection with the first intake passage 30. This intake switching mechanism 78 is further operably connected to the second intake passage 70 and engages one or both of these passages 30, 70 to open and close same. Preferably, the intake switching mechanism 78 engages one of the first 30 and second 70 intake passages based on a variable value. By closing a passage 30 or 70, the intake switching mechanism 78 closes an opening to the interior region 24 of the cabinet 22. Therefore, when a single passage 30 or 70 remains open and the vacuum unit 36 is operated, air is drawn through that open passage into the interior region 24 of the cabinet 22. Accordingly, the intake switching mechanism 78 regulates whether air is drawn from outdoors 36 or indoors 72.

As discussed above, the vacuum unit 36 is operated to draw air through the open passage 30 or 70. In a previously described example, the operator selects and rotates the intake switching mechanism 78 to open the second intake passage 70 (See FIG. 16). The operator then turns on the vacuum unit 36 to draw air into the interior region 24 of the cabinet 22 from indoors 72, effectively increasing dryer efficiency on a humid or cool day. Conversely, when the temperature is higher, or when humidity is low, the operator may select to engage the intake switching mechanism 70 to open the first intake passage 30. As a result, air is drawn into the interior region 24 of the cabinet 22 from outdoors 34 to provide a clothesline fresh appearance, feel, and smell to clothes received within the cabinet, as well as to increase dryer efficiency. The efficiency of an apparatus operated in this manner is increased to approximately 12 lbs. per kilowatt hour from the 3.1 lbs. per kilowatt hour efficiency of conventional dryers.

To engage the intake switching mechanism 84 with a passage 30, 70, an operator enters a command into the control unit 84, as described above. The control unit 84 then sends a signal to the intake switching mechanism 78 to close either the first intake passage 30 or the second intake passage 70, while retaining the non-designated passage in the open position. Once the passage 30 or 70 is closed, an operator enters a command into the programmable interface 87 which is operably connected to the vacuum unit 36. The command signals that the vacuum unit 36 should be activated. After the command is entered, a signal is communicated to the vacuum unit 36 which triggers the vacuum unit 36 to activate. The vacuum unit 36 then draws air into the interior region 24 of the cabinet 22 through the open passage, circulates that air within the interior region 24 cabinet, and exhausts the air to the exterior of the apparatus 20.

As discussed previously, air may be exhausted outdoors or indoors, based on the operator's preference. Namely, the operator uses an exhaust control knob 79 (FIG. 1) to select whether to exhaust air indoors, or outdoors. The exhaust control knob 79 is operably connected to an exhaust switching mechanism 110 (FIG. 17). The exhaust switching mechanism 110, is rotatably and hingedly connected at one end to the housing 33 of the vacuum unit 36, so that the opposite end moves toward the passage 98 or 100 to be closed. As a result, air is expelled through an open passage 98 or 100.

The choice to open or close a respective exhaust passage 98, 100 could be based on any reason, such as environmental conditions or other factors. Furthermore, the control unit 79 and/or the exhaust switching mechanism 10 may be operably connected to a CPU or other programmable interface 87, in which case, a command is entered into the CPU to designate the direction of exhaust. A signal is then sent to the control unit 79, which rotates the exhaust switching mechanism 110 to select the desired passage 98, 100.

Figure 21:
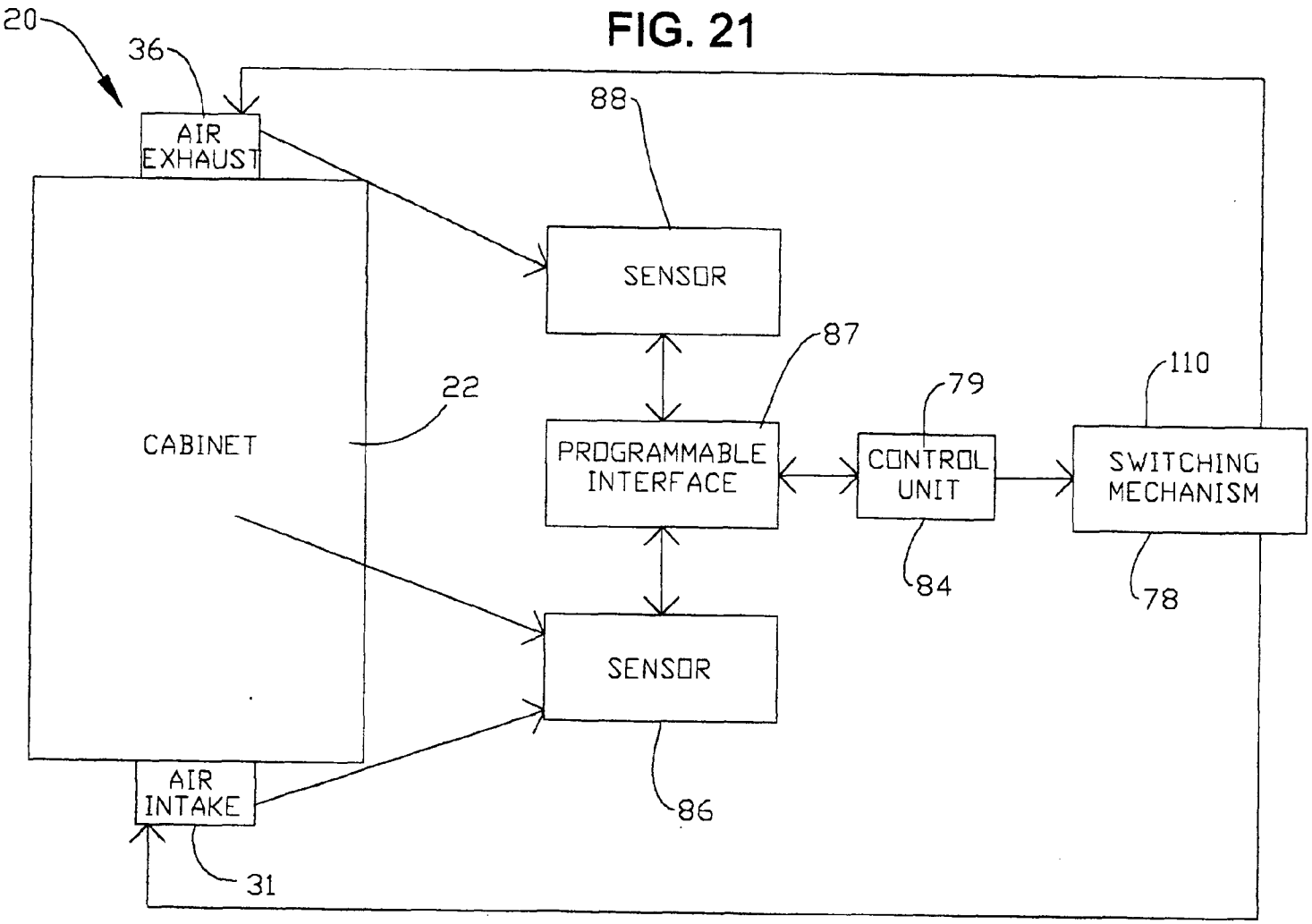
FIG. 21 shows a flow chart of the relationship between the sensors, the clothes drying apparatus, the programmable interface, the control unit, and the switching mechanism of the present invention.

A first sensor 86 for detecting a variable value is operably connected to the control unit 84 for the intake switching mechanism 78 (See FIGS. 5 and 21). In a further embodiment of the method of the present invention, the first sensor 86 monitors a variable value and communicates that value to the control unit 84 preferably in connection with a programmable interface 87. In response, the control unit 84 communicates with the intake switching mechanism 78 to selectively engage the intake switching mechanism 78 with one of the first 30 or second 70 intake passages based on the variable value.

In a preferred embodiment, a variable value limit is set by the operator, and entered into a programmable interface 87 that is operably connected to the control unit 84. The first sensor 86 continually monitors or detects the variable and communicates same to programmable interface 87. At the time the value detected by the first sensor 86 reaches the set variable value limit, the programmable interface sends a signal to trigger the control unit 84 to engage and close either the first 30 or second 70 intake passage, thereby rotating the switching mechanism 78, as was previously discussed herein.

Moreover, in the two sensor embodiment of the present invention, the second sensor 88 is provided within the duct work of the vacuum unit 36 and/or exhaust passages 98, 100 for detecting a variable. (Note, in this case, the first sensor 86 would preferably be located within the intake passages 30, 70, or linking assembly 31.) See FIGS. 16–18 and 21. The second sensor 88 both detects and monitors a variable. In the preferred embodiment of the method of the present invention, this value corresponds to the point at which the clothes received within the cabinet 22 are dry. Like the first sensor 86, an operator enters a variable value limit into the programmable interface 87. This variable value limit corresponds to a time at which the clothes drying apparatus 20 should shut down (See FIG. 19). The second sensor 88 communicates this value to the CPU. Upon detection of the variable value limit by the second sensor 88, and communication of the value to the CPU, the CPU triggers the control unit 84 to shut down the vacuum unit 36. When the vacuum unit 36 receives this signal, no additional air is drawn into or exhausted from the cabinet 22, avoiding damage to the clothes received within the cabinet 22 by a continued flow of air.

The clothes drying apparatus and method of drying clothes is adaptable to fit a wide variety of clothes drying devices and processes. The embodiments shown are especially well suited for drying clothes not suitable for a conventional dryer. However, the invention is in no way so limited. For instance, it would be obvious to dry any type of clothing article within the clothes drying apparatus 20 without departing from the overall scope of the invention.

The foregoing description and drawings merely explain and illustrate preferred embodiments of the invention, and the invention is not limited thereto, except insofar as the claims are so limited. Those skilled in the art, who have the disclosure before them, will be able to make modifications and variations therein without departing from the overall scope of the invention. For example, while embodiments are shown that provide first 30 and second 70 intake passages for drawing air into the interior region 24 of the cabinet 22, additional passages or apertures may be included in the clothes drying apparatus 20 without departing from the overall scope of the invention.

What is claimed is:

1. A clothes drying apparatus comprising:

a cabinet defining an interior region for receiving an article of clothing;

at least one door operably connected to said cabinet, allowing access to said interior region of said cabinet;

a means for holding said article of clothing received within said interior region of said cabinet;

a first intake passage in operable communication with said cabinet linking said cabinet to an exterior environment of a building; and a vacuum unit operably attached to said cabinet for drawing air from said exterior environment of a building through said passage and into said interior region of said cabinet.

2. The clothes drying apparatus of claim 1, further comprising:

a second intake passage in operable communication with said cabinet linking said cabinet to an interior environment of a building; and a intake switching mechanism operably connected to said first intake passage and said second intake passage, said switching mechanism capable of engaging one of said first and second intake passages, said engagement of said intake switching mechanism enabling said vacuum unit to selectively and alternatively draw air from said exterior environment of a building and said interior environment of a building.

3. The clothes drying apparatus of claim 2, further comprising a sensor capable of detecting a variable, said sensor in operable communication with said intake switching mechanism.

4. The clothes drying apparatus of claim 3, wherein said sensor is capable of monitoring said exterior environment of a building.

5. The clothes drying apparatus of claim 4, further comprising a second sensor capable of detecting a variable within said interior region of said cabinet, said variable indicating clothing dryness.

6. The clothes drying apparatus of claim 3, wherein said sensor is capable of monitoring clothing dryness.

7. The clothes drying apparatus of claim 3, wherein said variable is selected from the group consisting of humidity and temperature.

8. The clothes drying apparatus of claim 1, wherein said cabinet comprises a floor having a drain, said drain operably connected to said interior region of said cabinet.

9. The clothes drying apparatus of claim 1, wherein said means for holding said article of clothing comprises a rod.

10. The clothes drying apparatus of claim 1, further comprising exhausting means for exhausting air out of said clothes drying apparatus, said exhausting means capable of selectively exhausting air into an interior or an exterior of a building.

11. The clothes drying apparatus of claim 1, wherein said cabinet is insulated.

12. The clothes drying apparatus of claim 1, wherein said interior region of said cabinet comprises means for receiving footwear.

13. A method of drying an article of clothing within a clothes drying apparatus, said method comprising:

providing a cabinet defining an interior region for receiving an article of clothing;

providing at least one door in operable connection with said cabinet, said door allowing access to said interior region of said cabinet;

placing said article of clothing inside said interior region of said cabinet;

closing said door to enclose said article of clothing within said cabinet;

providing a first intake passage in operable communication with said cabinet;

connecting said interior region of said cabinet to an exterior environment of a building with said first intake passage;

providing a vacuum unit in operable communication with said cabinet for drawing air into said interior region of said cabinet;

drawing air from said exterior environment of a building into said interior region of said cabinet with said vacuum unit; and circulating said air within said interior region of said cabinet to dry said article of clothing received within said interior region of said cabinet.

14. The method of drying clothes of claim 13, further comprising:

providing a second intake passage in operable communication with said cabinet;

connecting said interior region of said cabinet to an interior environment of a building with said second intake passage;

providing a intake switching mechanism in operable connection with said first intake passage and said second intake passage for engaging one of said first and second intake passages with said interior region of said cabinet;

engaging one of said first and second intake passages with said interior region of said cabinet with said intake switching mechanism; and drawing air through said passage engaged by said switching mechanism.

15. The method of drying clothes of claim 14, wherein said switching mechanism selects one of said first and second intake passages based on a variable.

16. The method of drying clothes of claim 15, further comprising:

providing a first sensor capable of detecting said variable from said exterior environment of a building and capable of communicating said variable to said switching mechanism;

detecting said variable with said sensor, said sensor communicating with said switching mechanism following the detection of said variable; and engaging said switching mechanism with one of said first and second intake passages upon said communication by said sensor.

17. The method of drying clothes of claim 16, wherein said variable value is selected from the group consisting of humidity and temperature.

18. The method of drying clothes of claim 13, further comprising:

providing a second sensor capable of detecting a variable in said interior region of said cabinet, said second sensor capable of communicating with said vacuum unit;

detecting said variable with said sensor, said sensor communicating with said vacuum unit following the detection of said variable; and stopping the operation of said vacuum unit upon said communication by said sensor.

* * * * *